US007548709B2

(12) United States Patent
Hirai et al.

(10) Patent No.: US 7,548,709 B2
(45) Date of Patent: Jun. 16, 2009

(54) TRANSFER UNIT, TRANSFER METHOD, AND IMAGE FORMING APPARATUS

(75) Inventors: Masashi Hirai, Katano (JP); Kuniaki Nakano, Kyoto (JP); Masanori Yamada, Nara (JP); Takahiko Yoshida, Kashihara (JP); Kazuaki Ishikawa, Nara (JP); Hiroshi Tachiki, Nara (JP); Toshio Yamanaka, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 448 days.

(21) Appl. No.: 11/410,966

(22) Filed: Apr. 26, 2006

(65) Prior Publication Data

US 2006/0245782 A1 Nov. 2, 2006

(30) Foreign Application Priority Data

Apr. 27, 2005 (JP) ..... 2005-130563

(51) Int. Cl.
*G03G 15/16* (2006.01)

(52) U.S. Cl. ..... 399/101; 399/71; 399/297

(58) Field of Classification Search ..... 399/71, 399/101, 297

See application file for complete search history.

(56) References Cited

U.S. PATENT DOCUMENTS 5,621,509 A * 4/1997 Karashima et al. ..... 399/66
5,923,939 A 7/1999 Koyama et al.
6,035,154 A 3/2000 Takahata et al.
6,766,125 B1 * 7/2004 Izumi ..... 399/101
2007/0206970 A1 * 9/2007 Izumi et al. ..... 399/101

FOREIGN PATENT DOCUMENTS

JP 01226648 A * 9/1989
JP 06-019276 1/1994
JP 06-314035 11/1994
JP 10-049019 2/1998
JP 10-221974 8/1998
JP 11-7202 A 1/1999
JP 2000-112267 A 4/2000
JP 2002-014545 1/2002
JP 2003-140470 5/2003

* cited by examiner

*Primary Examiner*—David M Gray
*Assistant Examiner*—Ryan D Walsh
(74) *Attorney, Agent, or Firm*—Birch, Stewart, Kolasch & Birch, LLP

(57) ABSTRACT

A transfer unit includes: an intermediate transfer belt that (i) holds a toner image that has been transferred from a photoreceptor drum and (ii) moves a surface holding the toner image; and a secondary transfer belt that comes into contact with the intermediate transfer belt. The transfer unit (i) transfers the toner image from the intermediate transfer belt to a sheet conveyed to the secondary transfer part and (ii) includes a cleaning unit that removes and collects toner from the surface of the intermediate transfer belt. The transfer unit also includes a power source for sequentially applying, to the secondary transfer belt, (i) a first voltage for generating an electric field that transfers normally-charged toner from the secondary transfer belt to the intermediate transfer belt and (ii) a second voltage for generating an electric field that transfers oppositely-charged toner from the secondary transfer belt to the intermediate transfer belt.

16 Claims, 8 Drawing Sheets

TRANSFER UNIT, TRANSFER METHOD, AND IMAGE FORMING APPARATUS

This Nonprovisional application claims priority under 35 U.S.C. § 119(a) on patent application Ser. No. 130563/2005 filed in Japan on Apr. 27, 2005, the entire contents of which are hereby incorporated by reference.

BACKGROUND OF INVENTION

1. Field of the Invention

The present invention relates to a transfer unit, a transfer method, and an image forming apparatus, which adopt an intermediate transfer method in which an intermediate transfer member is used and a toner image is transferred from the intermediate transfer member to a sheet.

2. Description of the Related Art

A color image forming apparatus is provided with a transfer unit that transfers a color toner image formed by an image forming section onto a sheet. A known transfer method adopted by conventional transfer units is an intermediate transfer method in which (i) color toner images are formed by image forming sections that produce different colors, and are sequentially transferred onto an intermediate transfer member such that the color toner images are overlaid on top of each other (primary transfer), and then (ii) the overlaid color toner images are simultaneously transferred onto a sheet in one transfer step (secondary transfer). In the intermediate transfer method, the thickness of the overlaid color toner images formed on the intermediate transfer member is thicker than that of a monochrome toner image. As such, it is effective to utilize a transfer belt, in addition to the intermediate transfer member, as a secondary transfer member for transferring a toner image onto a sheet. This increases the transfer nip, and therefore the color toner image is transferred onto a sheet more efficiently.

In this manner, the transfer efficiency of the toner image onto a sheet can be improved by the secondary transfer method utilizing a transfer belt. This, however, causes not only the toner image but also "toner-fog", which is originated from a residual electric potential, to be transferred onto the transfer belt. Consequently, the transfer belt is contaminated. Therefore, a cleaning mechanism for the transfer belt will be necessary.

Generally, a mechanical mechanism utilizing a cleaning blade is most always adopted as the cleaning mechanism. However, if the transfer belt to be cleaned is thin and soft, then it is not desirable to bring a hard blade into contact with such a transfer belt because this may cause various problems. For example, wrinkles may be generated on the belt, the belt may wobble, or the belt may be damaged. Such problems may arise not only in the case where the transfer belt is used as the secondary transfer member, but also in a case where a soft transfer roller is utilized so as to increase the transfer nip.

As a countermeasure, for the cleaning of the secondary transfer member (e.g., the transfer belt, the transfer roller), a method is commonly adopted in which an electric field is applied to the secondary transfer member, which electric field has the opposite polarity to that of an electric field for transferring a toner image from the intermediate transfer member onto a sheet, so that unnecessary toner adhered to the secondary transfer member is transferred back to the intermediate transfer member. Such art and related art are taught in Japanese Unexamined Patent Publications, No. 112267/2000 (Tokukai 2000-112267) (published on Apr. 21, 2000) and No. 161051/1999 (Tokukaihei 11-161051) (published on Jun. 18, 1999).

However, not all toners adhered to the secondary transfer member (e.g., the transfer belt, the transfer roller) are normally-charged toners of a desired polarity, and some of the toners may be oppositely-charged or not charged at all. Therefore, if an electric field having the opposite polarity to that of the electric field for transferring is applied to the secondary transfer member, the normally-charged toner is transferred back to the intermediate transfer member but the oppositely-charged toner and uncharged toner remain on the secondary transfer member. This causes a problem that the oppositely-charged toner and the uncharged toner generate fog on a sheet in a subsequent transfer step (for example, when the transfer step is performed on a sheet of a larger size).

SUMMARY OF THE INVENTION

The present invention thus has as an object to provide a transfer unit, a transfer method, and an image forming apparatus, in which toner from a secondary transfer member (e.g., transfer belt, transfer roller) can be suitably transferred to an intermediate transfer member, and the secondary transfer member can be desirably cleaned.

In order to solve the above problems, the transfer unit of the present invention includes: an intermediate transfer member that (i) holds a toner image that has been transferred, at a primary transfer part, from the toner image holding member and (ii) rotates to move a surface holding the toner image; a secondary transfer member that comes into contact, at a secondary transfer part, with the intermediate transfer member; and intermediate transfer member cleaning unit for removing and collecting toner from the toner image holding surface of the intermediate transfer member, the transfer unit transferring the toner image from the intermediate transfer member to a sheet conveyed to the secondary transfer part formed between the intermediate transfer member and the secondary transfer member, and the transfer unit is adapted so that the transfer unit further comprises secondary transfer member cleaning unit for sequentially applying, to the secondary transfer member, (i) a first voltage for generating an electric field that transfers normally-charged toner from the secondary transfer member to the intermediate transfer member and (ii) a second voltage for generating an electric field that transfers oppositely-charged toner from the secondary transfer member to the intermediate transfer member.

Further, a transfer method of the present invention includes: a first step of transferring a toner image from an intermediate transfer member to a sheet conveyed to the secondary transfer part formed between the intermediate transfer member and the secondary transfer member, the intermediate transfer member being provided (a) to hold a toner image that has been transferred, at a primary transfer part, from a toner image holding member and (b) rotate to move the surface holding the toner image, and the secondary transfer member being provided to come into contact, at a secondary transfer part, with the intermediate transfer member; and a second step of removing and collecting the toner from the toner image holding surface of the intermediate transfer member, the transfer method further comprising a third step of sequentially applying (i) a first electric field for transferring normally-charged toner from the secondary transfer member to the intermediate transfer member and (ii) a second electric field for transferring oppositely-charged toner from the secondary transfer member to the intermediate transfer member.

In the above structure, (i) the first electric field for transferring the normally-charged toner from the secondary transfer member to the intermediate transfer member and (ii) the second electric field for transferring the oppositely-charged toner from the secondary transfer member to the intermediate transfer member are sequentially applied. Therefore, the unnecessary normally-charged toner and the oppositely-charged toner, both of which adhere to the secondary transfer member, are transferred back to the intermediate transfer member, so that the cleaning of the secondary transfer member is performed properly. Further, the toner transferred back to the intermediate transfer member from the secondary transfer member is collected by the intermediate transfer member cleaning unit of the intermediate transfer member. Therefore, the toner would not be transferred back to the secondary transfer member again from the intermediate transfer member.

BRIEF DESCRIPTION OF THE DRAWINGS

FIG. 4(*b*) is a schematic diagram illustrating the transfer unit in a monochrome printing operation. FIG. 4(*c*) is a schematic diagram illustrating the transfer unit in a color printing operation.

DETAILED DESCRIPTION OF THE INVENTION

The following describes one embodiment of the present invention, with reference to Figures. In the following description, it is assumed that "normally-charged toner" is negatively charged, and that "oppositely-charged toner" is positively charged. If the normally-charged toner is positively charged, the description should be read by simply reversing the polarities. Further, it is assumed that the charge is negative for the electric field which transfers the negatively-charged toner adhering to either a secondary transfer roller (secondary transfer member) 11 or a secondary transfer belt 102 back to an intermediate transfer belt (intermediate transfer member) 7, and that the charge is positive for the electric field which transfers the positively-charged toner back to the intermediate transfer belt 7.

Figure 2:
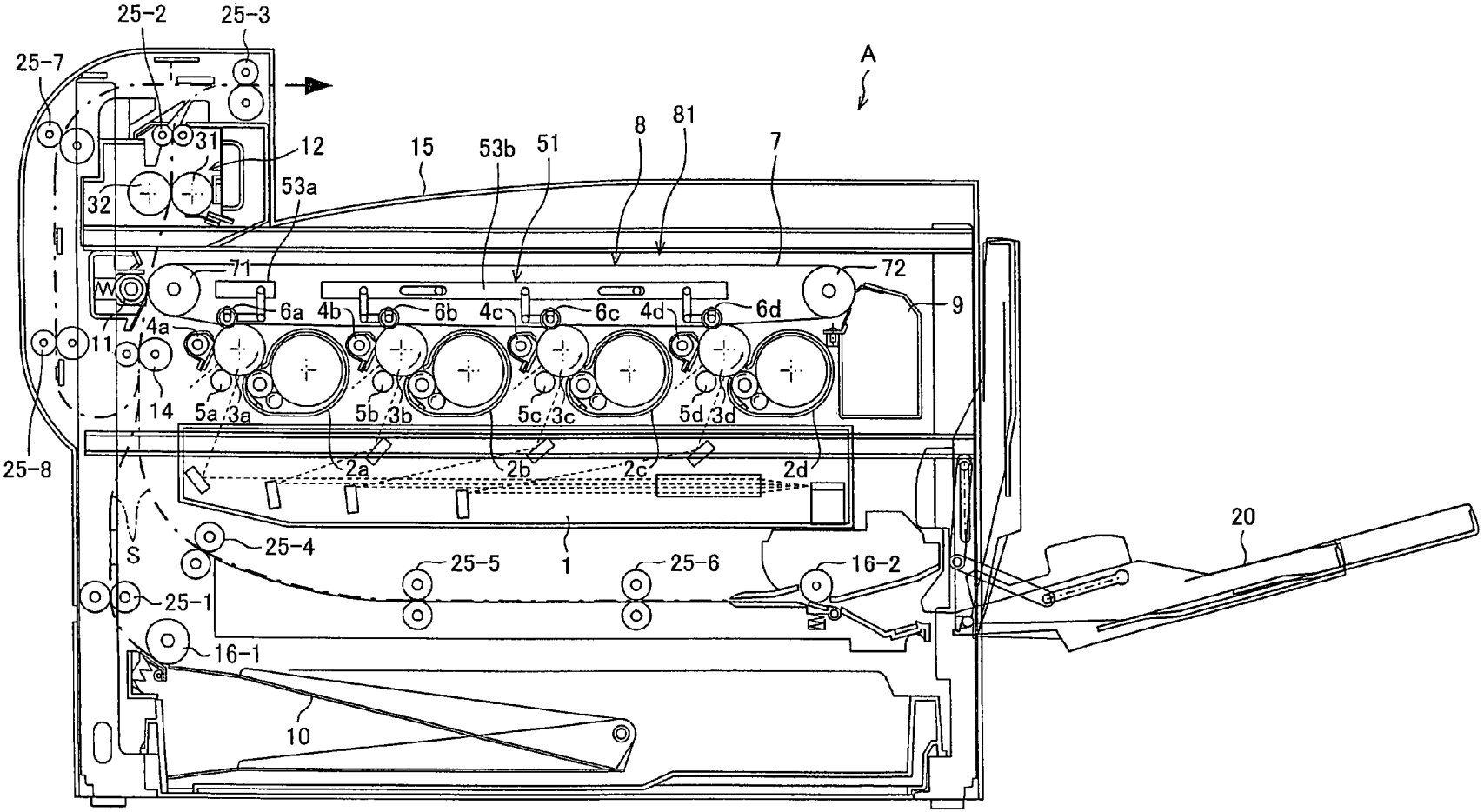
FIG. 2 is a longitudinal sectional diagram illustrating an image forming apparatus according to one embodiment of the present invention.

FIG. 2 is a diagram illustrating a structure of an image forming apparatus A of the present embodiment. The image forming apparatus A forms a multi-color image or a monochrome image on a sheet (recording sheet) based upon either externally supplied image data or image data obtained by reading a document.

As illustrated in FIG. 2, the image forming apparatus A is provided with an exposure unit 1, a development unit 2, a photoreceptor drum (toner image holding member) 3, a cleaner unit 4, a charging unit 5, an intermediate transfer belt unit 8, a fixing unit 12, a sheet convey path S, a sheet-feeding tray 10, an ejected sheet tray 15, among other components.

The image forming apparatus A handles image data of color images of black (K), cyan (C), magenta (M), and yellow (Y). In order to form four kinds of electrostatic latent images of the respective colors, four units are provided for each of the following components: the development unit 2 (2*a*, 2*b*, 2*c*, 2*d*); the photoreceptor drum 3 (3*a*,3*b*, 3*c*, 3*d*); the charging unit 5 (5*a*, 5*b*, 5*c*, 5*d*); and the cleaner unit 4 (4*a*, 4*b*, 4*c*, 4*d*). The reference codes "a", "b", "c", and "d" correspond to black, cyan, magenta, and yellow, respectively. The components having the same reference code constitute one image station, so that four image stations are formed.

In each image station, the photoreceptor drum 3 is disposed at an upper part of the image forming apparatus A. The charging unit 5 uniformly charges the surface of the photoreceptor drum 3 to a predetermined electric potential. For the charging unit 5, not only the contact roller type charging unit shown in FIG. 2 but also a contact brush type charging unit or a charger type charging unit may be adopted.

As illustrated in FIG. 2, the exposure unit 1 utilizes a laser scanning unit (LSU) provided with a laser emitting section and a reflection mirror. Alternatively, the exposure unit 1 may utilize, for example, an EL or LED writing head, which includes arrayed light emitting diodes. The exposure unit 1 exposes, according to supplied image data, the charged surface of the photoreceptor drum 3 so that an electrostatic latent image corresponding to the image data is formed on the surface of the photoreceptor drum 3.

The development unit 2 visualizes, by using toners of K, C, M, and Y, the electrostatic latent image formed on the photoreceptor drum 3. The cleaner unit 4 removes and collects residual toner from the surface of the photoreceptor drum 3 after the image is developed and transferred.

The intermediate transfer belt unit 8 is disposed above the photoreceptor drum 3, and is provided with a primary transfer rollers 6 (6*a* to 6*d*), an intermediate transfer belt 7, a back-up roller 71 that functions as a driving roller, a driven roller 72, an intermediate transfer belt separating mechanism (intermediate transfer member separating means) 51, and an intermediate transfer belt cleaning unit (intermediate transfer member cleaning means) 9.

The intermediate transfer belt 7 is suspended by, for example, the primary transfer roller 6, the back-up roller 71, and the driven roller 72. The intermediate transfer belt 7 is driven by these members to rotate in the direction of the arrow B.

The primary transfer rollers 6*a*-6*d* are rotatably disposed in places (i) on the downstream side of the photoreceptor drums 3*a*-3*d* in the rotation direction of the intermediate transfer belt 7 and (ii) where the primary transfer rollers 6*a*-6*d* are not in direct contact with the photoreceptor drums 3*a*-3*d* by having the intermediate transfer belt 7 therebetween. Accordingly, the intermediate transfer belt 7 is pressed against the photoreceptor drums 3 (3*a* to 3*d*) by the primary transfer rollers 6 (6*a* to 6*d*) so as to come into contact with the photoreceptor drums 3 (3*a* to 3*d*). The primary transfer rollers 6 (6*a* to 6*d*) apply a transfer bias for transferring the toner image from the photoreceptor drums 3 (3*a* to 3*d*) onto the intermediate transfer belt 7.

According to the present embodiment, in order to maintain a constant amount of primary transfer bias applied to the intermediate transfer belt 7, a primary transfer bias is applied to all of the primary transfer rollers 6*a*-6*d* both in forming a monochrome image and in forming a multi-color image. Therefore, all of the primary transfer rollers 6*a*-6*d* are always in contact with the intermediate transfer belt 7. If not all of the primary transfer rollers 6*a*-6*d* were always in contact with the intermediate transfer belt 7, then the amount of primary transfer bias applied to the intermediate transfer belt 7 would change each time an image is formed, and as a result accuracy of transfer would fluctuate.

The intermediate transfer belt 7 is so disposed that it can be brought into contact with the respective photoreceptor drums 3. Toner images of the respective colors are transferred from the surface of the photoreceptor drums 3 onto the intermediate transfer belt 7 such that the toner images are sequentially overlaid on top of each other. As a result, a color toner image (multi-color toner image) is formed on the intermediate transfer belt 7. The intermediate transfer belt 7 is a loop and is made of a film with a thickness of approximately 100 μm to 150 μm.

The toner image is transferred from the photoreceptor drums 3 to the intermediate transfer belt 7 by the primary transfer rollers 6, which are in contact with the back face of the intermediate transfer belt 7. The primary transfer rollers 6 are applied with a high-voltage transfer bias (high-voltage whose polarity (+) is opposite to that (−) of the toner charges) for transferring the toner image. Each of the primary transfer rollers 6 is primarily constituted of a metal shaft (e.g., stainless steel shaft) with a diameter of 8 mm to 10 mm, and the surface thereof is covered by conductive and elastic material (e.g., EPDM, urethane foam). The conductive and elastic material enables the primary transfer rollers 6 to uniformly apply a high-voltage to the intermediate transfer belt 7. In the present embodiment, the roller-type transfer electrode (primary transfer roller 6) is utilized, but other types of transfer electrodes, for example a brush-type transfer electrode, may also be utilized.

As described above, the electrostatic latent images on the photoreceptor drums 3 are visualized with the toners of the respective hues, so that toner images are formed. The toner images are overlaid on top of the other on the intermediate transfer belt 7. The overlaid toner images are moved, along with the rotation of the intermediate transfer belt 7, to a position where a conveyed sheet comes into contact with the intermediate transfer belt 7. Then, the toner images are transferred onto the sheet by the secondary transfer roller 11 disposed at this position. Here, the intermediate transfer belt 7 and the secondary transfer roller 11 press against each other with a predetermined nip, while the secondary transfer roller 11 is applied with a voltage for transferring the toner images onto the sheet. The voltage is a high-voltage having the opposite polarity (+) to that of the toner charge (−).

In order to maintain the nip constant, (i) one of the secondary transfer roller 11 and the back-up roller 71 is made of hard material (e.g., metal), and (ii) the other one is made of soft material, such as elastic roller (e.g., elastic rubber roller, foaming-resin roller).

The toner adhered to the intermediate transfer belt 7 by the contact with the photoreceptor drum 3 causes the toner colors to be mixed in the subsequent processes. Further, the toner that was not transferred from the intermediate transfer belt 7 onto the sheet and therefore remains on the intermediate transfer belt 7 also causes the toner colors to be mixed in the subsequent processes. Thus, these toners are removed and collected by the intermediate transfer belt cleaning unit 9.

The intermediate transfer belt cleaning unit 9 is provided with a cleaning member (e.g., cleaning blade) that is in contact with the intermediate transfer belt 7. The intermediate transfer belt cleaning unit 9 mechanically scratches off and collects the toner from the intermediate transfer belt 7 by using the cleaning blade. The portion of the intermediate transfer belt 7 in a portion where the cleaning blade is in contact with the intermediate transfer belt 7 is supported by the driven roller 72 from the back side.

On the sheet-feeding tray 10, sheets (e.g., recording sheet) on which images are to be formed are stacked. The sheet-feeding tray 10 is disposed below the image forming section and the exposure unit 1. On the other hand, the ejected sheet tray 15 is disposed at an upper part of the image forming apparatus A. On the ejected sheet tray 15, printed sheets are stacked in such a way that the printed sides face downward.

Further, the image forming apparatus A is provided with a sheet convey path S through which a sheet is conveyed from the sheet-feeding tray 10, or a manual sheet-feeding tray 20, to the ejected sheet tray 15 via the secondary transfer roller 11 and the fixing unit 12. Along the sheet convey path S between the sheet-feeding tray 10 and the ejected sheet tray 15, for example a pick-up roller 16, a registration roller 14, a secondary transfer unit 86, the fixing unit 12, and a convey rollers 25 are disposed. The secondary transfer unit 86 is provided with a secondary transfer roller 11.

The convey rollers 25 are small rollers that facilitate and support conveying the sheets. The convey rollers 25 are disposed along the sheet convey path S. The pick-up roller 16 functions as a guiding roller, and is disposed at an end portion of the sheet-feeding tray 10. The pick-up roller 16 conveys sheets, one by one, from the sheet-feeding tray 10 to the sheet convey path S. The registration roller 14 temporarily holds the sheet being conveyed through the sheet convey path 5, so as to send the sheet to a secondary transfer part at such a timing that the front end of the toner image formed on the intermediate transfer belt 7 meets the front end of the sheet.

The fixing unit 12 is provided with, for example, a heat roller 31 and a pressure roller 32. The heat roller 31 and the pressure roller 32 rotate with a sheet sandwiched therebetween. The heat roller 31 is so controlled by a controller (not illustrated) as to have a predetermined fusing temperature. The controller controls the heat roller 31 based upon a detection signal supplied by a temperature detection unit (not illustrated). The heat roller 31 and the pressure roller 33 apply heat and pressure to the sheet so that the color toner images transferred onto the sheet are melted, mixed, and pressed. As a result, the color toner images are fused with the sheet. The sheet with the fixed multi-color toner image (toner images of respective colors) is conveyed, by the convey rollers 25, to a reversed-sheet ejecting path of the sheet convey path S. Then, the sheet, which has been reversed upside down (the multi-color toner image is facing downward), is ejected to the ejected sheet tray 15.

The following describes how a sheet is conveyed through the sheet convey path S. Processes performed by the respective sections will also be described. The image forming apparatus A, as described above, is provided with (i) a sheet-feeding cassette 10 for storing sheets in advance and (ii) a manual sheet-feeding tray 20, which is used when a small number of sheets are used, for example. The sheet-feeding cassette 10 and the manual sheet-feeding tray 20 are provided with the pick-up roller 16 (16-1, 16-2), which supplies the sheets, one by one, to the sheet convey path S.

(Single-Sided Printing)

The sheet conveyed from the sheet-feeding cassette 10 is conveyed to the registration roller 14 by the convey roller 25-1 disposed on the sheet convey path S. The registration roller 14 sends the sheet to the secondary transfer part at such a timing that the front end of the sheet meets the front end of the toner image stacked on the intermediate transfer belt 7. At the secondary transfer part, the toner image is transferred onto the sheet. Thereafter, the toner image is fixed to the sheet by the fixing unit 12. Then, the sheet is conveyed to the convey roller 25-2 and then to the sheet ejection roller 25-3. Finally, the sheet is ejected to the ejected sheet tray 15.

Further, the sheet conveyed from the manual sheet-feeding tray 20 is conveyed to the registration roller 14 by the plurality of convey rollers 25 (25-6, 25-5, 25-4). Subsequently, the sheet is conveyed through the same path through which the sheet supplied from the sheet-feeding cassette 10 is conveyed. Finally, the sheet is ejected to the ejected sheet tray 15.

(Double-Sided Printing)

The sheet having had its one side printed in the way described above is conveyed via the fixing unit 12, and then the sheet ejection roller 25-3 catches the rear end of the sheet. The sheet ejection roller 25-3 rotates in the reverse direction so that the sheet is guided to the convey rollers 25-7 and 25-8. Then, the sheet is conveyed through the registration roller 14, and the back face of the sheet is printed. Finally, the sheet is ejected to the ejected sheet tray 15.

Figure 3:
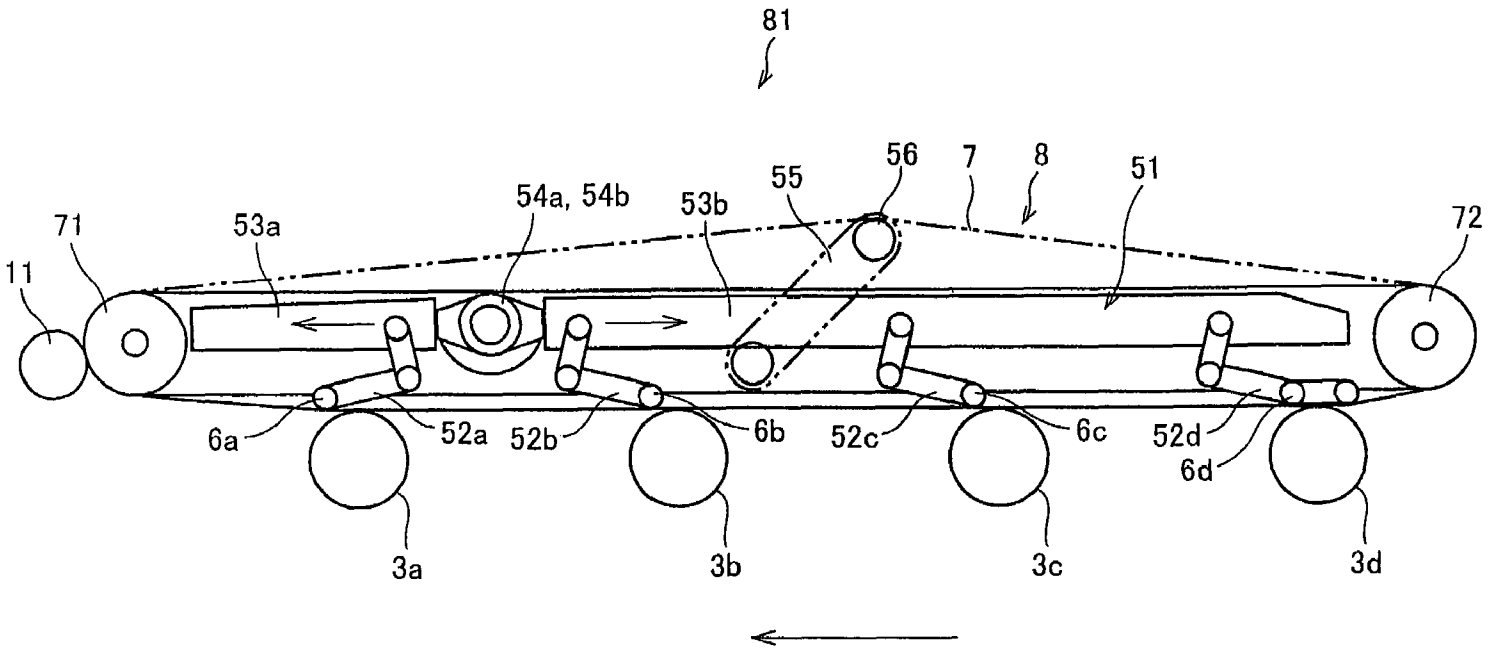
FIG. 3 is a schematic diagram illustrating a transfer unit provided in the image forming apparatus shown in FIG. 2.

FIG. 3 is a front view diagram illustrating a main part of the transfer unit 81 provided in the image forming apparatus A. The transfer unit 81 is provided with the intermediate transfer belt unit 8, the secondary transfer roller 11, and the intermediate transfer belt cleaning unit 9 shown in FIG. 2. In the intermediate transfer belt unit 8, the intermediate transfer belt 7 can be brought into contact with or separated from the photoreceptor drum 3. For this purpose, the intermediate transfer belt unit 8 is provided with an intermediate transfer belt separating mechanism 51 that moves the primary transfer roller 6 so as to displace the intermediate transfer belt 7 from the photoreceptor drum 3.

In the intermediate transfer belt separating mechanism 51, the primary transfer rollers 6*a*-6*d* are held on one end of L-shaped roller lifting members 52*a*-52*d*. The roller lifting members 52*a*-52*d* have an L-shape on the cross section taken along the line orthogonal to the axial direction of the primary transfer rollers 6*a*-6*d*. The roller lifting members 52*a*-52*d* have bending parts where the roller lifting members 52*a*-52*d* are freely supported on axes parallel to the axial direction of the primary transfer rollers 6*a*-6*d*. The top end (other end) of the roller lifting member 52*a* is engaged with a sliding member 53*a*, whereas the top ends of the roller lifting members 52*b*-52*d* are engaged with sliding member 53*b*.

Figure 4:
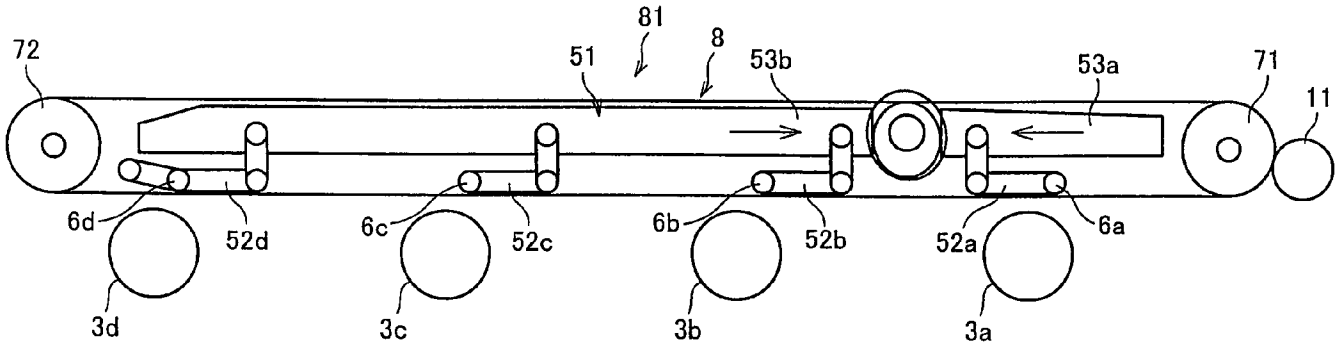
FIG. 4(*a*) is a schematic diagram illustrating an intermediate transfer belt in a state where it is separated from a photoreceptor drum in the transfer unit shown in FIG. 3.
Figure 4:
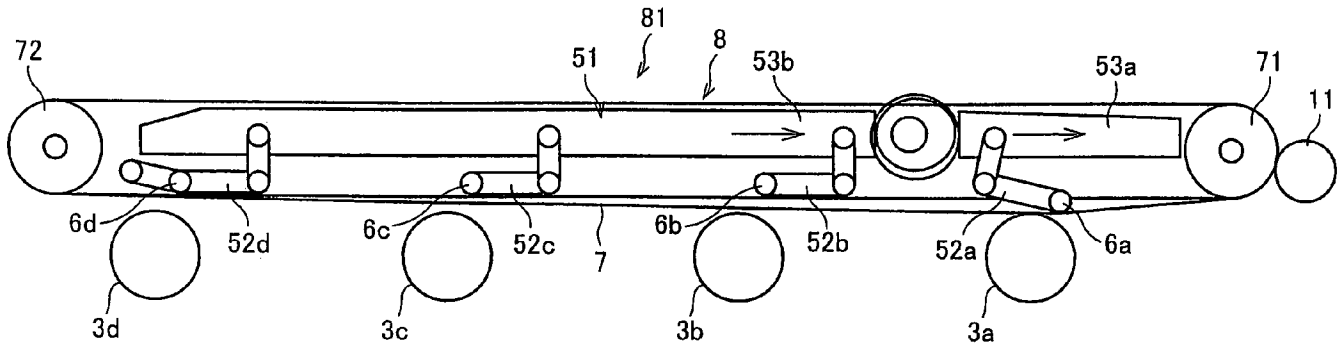
Figure 4:
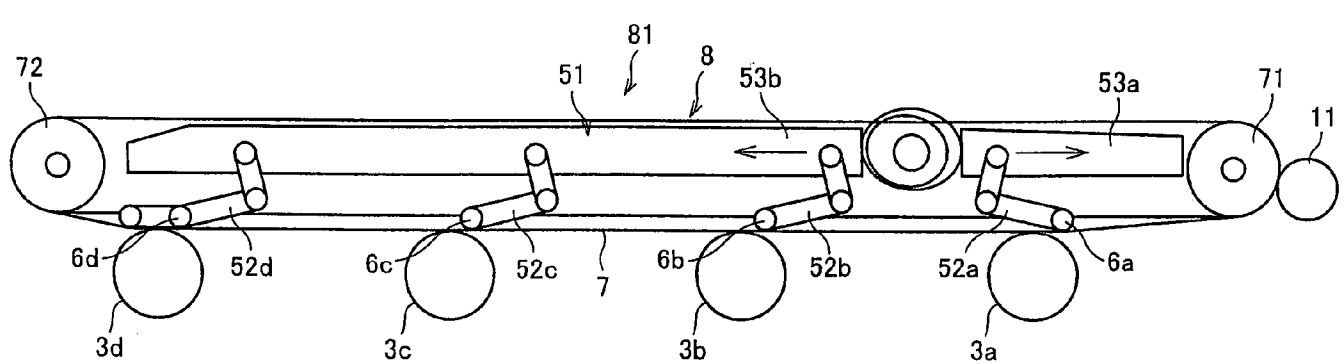

The sliding members 53*a* and 53*b* are driven by, for example, a cam mechanism (54*a*, 54*b*) such that the sliding members 53*a* and 53*b* freely move back and forth in the horizontal direction. When the sliding members 53*a* and 53*b* move in the horizontal direction, the roller lifting members 52*a*-52*d* also move. Consequently, the primary transfer roller 6*a* solely moves towards and away from the photoreceptor drums 3*a*, whereas the primary transfer rollers 6*b*-6*d* move together towards and away from the photoreceptor drums 3*b*-3*d*. Thus, in the intermediate transfer belt separating mechanism 51, as illustrated in FIGS. 4(*a*) to 4(*c*), the intermediate transfer belt 7 can be positioned (i) in complete separation from all of the photoreceptor drums 3*a*-3*d*, (ii) for monochrome image formation, or (iii) for multi-color image formation. FIGS. 4(*a*) to 4(*c*) are diagrams illustrating the transfer unit 81 of FIG. 3 as viewed from the back side.

Specifically, when the intermediate transfer belt 7 is positioned in complete separation from the photoreceptor drums 3*a*-3*d*, as illustrated in FIG. 4(*a*), all primary transfer rollers 6*a*-6*d* are lifted up so that the intermediate transfer belt 7 is completely separated from all of the photoreceptor drums 3*a*-3*d*. Generally, this position is assumed (i) in a stand-by state when no image is formed or (ii) in cleaning the secondary transfer roller 11 and the secondary transfer belt 102 in the present embodiment.

Further, when the intermediate transfer belt 7 is positioned for the monochrome image formation, as illustrated in FIG. 4(*b*), only the primary transfer roller 6*a* is lifted down towards the photoreceptor drum 3*a*. Consequently, the intermediate transfer belt 7 is partially pressed against the photoreceptor drum 3*a* such that the intermediate transfer belt 7 is brought into contact with the photoreceptor drum 3*a* only in the vicinity of the primary transfer roller 6*a*. The portion where the intermediate transfer belt 7 is in contact with the photoreceptor drum 3 constitutes a primary transfer part.

Finally, when the intermediate transfer belt 7 is positioned for the multi-color image formation, as illustrated in FIG. 4(*c*), all of the primary transfer rollers 6*a*-6*d* are lifted down towards the photoreceptor drums 3*a*-3*d* because all primary transfer rollers 6*a*-6*d* are utilized in the primary transfer (transfer of toner images from the photoreceptor drums 3*a*-3*d* to the intermediate transfer belt 7). Consequently, the intermediate transfer belt 7 is pressed against the photoreceptor drums 3*a*-3*d* such that the intermediate transfer belt 7 is brought into contact with the photoreceptor drums 3*a*-3*d* in the respective vicinities of the primary transfer rollers 6*a*-6*d*.

Note that, as illustrated in FIG. 3, a tension roller 56 supported on one end of a lever 55 moves up and down according to the position of the intermediate transfer belt 7. As a result, the tension of the intermediate transfer belt 7 is maintained constant.

Further, the intermediate transfer belt separating mechanism 51 is not limited to that described above, provided that the intermediate transfer belt separating mechanism 51 is capable of (i) separating the intermediate transfer belt 7 from the photoreceptor drums 3*a*-3*d* and (ii) bringing the intermediate transfer belt 7 into contact with the photoreceptor drums 3*a*-3*d*. Other known structures may also be adopted.

Figure 1:
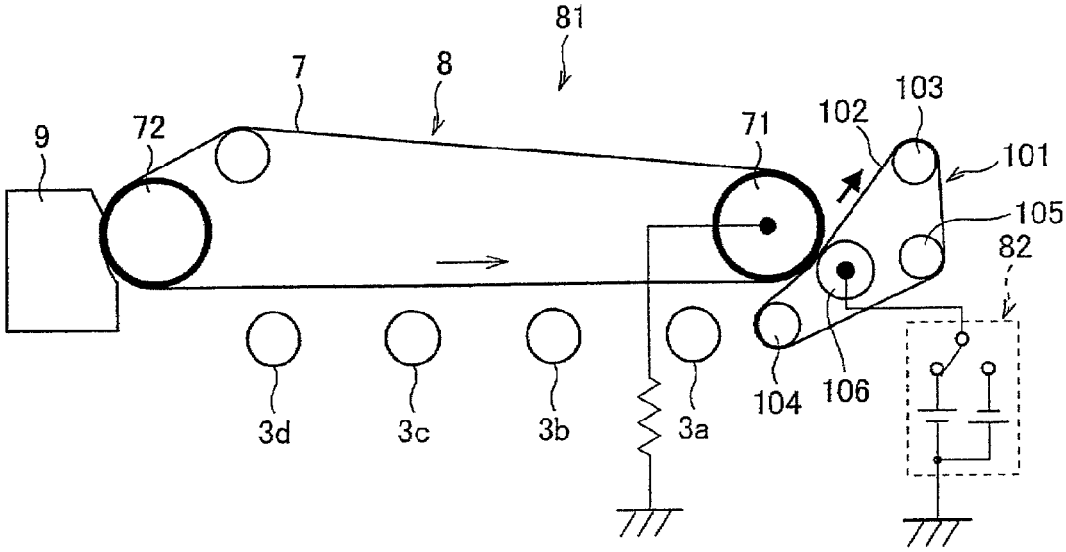
FIG. 1 is a schematic diagram illustrating a transfer unit according to one embodiment of the present invention.

FIG. 1 is another diagram schematically illustrating a structure of the transfer unit 81. In the transfer unit 81 shown in FIG. 1, the secondary transfer roller 11 shown in FIGS. 3 and 4 is replaced by a secondary transfer belt unit 101. The secondary transfer belt unit 101 is provided with a secondary transfer belt 102, three supporting rollers 103-105, and a small-diameter secondary transfer roller 106. The supporting rollers 103-105 suspend the secondary transfer belt 102. One of the supporting rollers 103-105 (e.g., the supporting roller 103) functions as a driving roller while the other two supporting rollers (e.g., supporting rollers 104 and 105) function as driven rollers. The small-diameter secondary transfer roller 106 is so disposed as to be in contact with the back face of the secondary transfer belt 102.

The secondary transfer belt 102 is made of, for example, rubber material, and has a volume resistivity of $10^{10}$ Ω·cm and a surface resistivity of $10^{11}$Ω. The small-diameter secondary transfer roller 106 is made of, for example, NBR and epichlorohydrin.

At the secondary transfer part where the back-up roller 71 comes into contact with the secondary transfer belt unit 101, the back-up roller 71 is pressed against the secondary transfer belt 102 so as to go beyond a plane defined by a common tangential line of the supporting roller 103 and the supporting roller 104. This ensures a sufficient nip width for the secondary transfer.

If a mechanical cleaning mechanism were provided for the secondary transfer belt 102 that is made of flexible material, then (i) wrinkles are easily generated on the transfer belt, (ii) the transfer belt easily wobbles, and (iii) the transfer belt is easily damaged. Therefore, it is not preferable to provide the secondary transfer belt 102 with a mechanical cleaning mechanism. As such, in the transfer unit 81, the secondary transfer belt 102 is provided with an electric cleaning mechanism by which the unnecessary toner on the surface of the secondary transfer belt 102 is transferred back to the intermediate transfer belt 7. On the other hand, the intermediate transfer belt 7 is provided with a mechanical cleaning mechanism by which the residual toner on the surface of the intermediate transfer belt 7 is mechanically scratched off and removed. The toner transferred back to the intermediate transfer belt 7 from the secondary transfer belt 102 is removed and collected from the surface of the intermediate transfer belt 7 by the cleaning mechanism of the intermediate transfer belt 7.

The intermediate transfer belt cleaning unit 9, which functions as a mechanical cleaning mechanism for cleaning the intermediate transfer belt 7, mechanically scratches off the toner from the surface of the intermediate transfer belt 7 by using, for example, a cleaning blade. Note that the intermediate transfer belt cleaning unit 9 may utilize, for example, a cleaning brush in place of the cleaning blade.

In the electric cleaning mechanism utilized for cleaning the secondary transfer belt 102, a negative electric field and a positive electric field are alternately applied between the secondary transfer belt 102 and the back-up roller 71. In other words, a cleaning electric field is applied between the secondary transfer belt 102 and the back-up roller 71. The negative electric field is an electric field for transferring the negatively-charged toner (normally-charged toner) adhered to the secondary transfer belt 102 back to the intermediate transfer belt 7, whereas the positive electric field is an electric field for transferring the positively-charged toner (oppositely-charged toner) adhered to the secondary transfer belt 102 back to the intermediate transfer belt 7.

In order to generate the cleaning electric field, a secondary transfer power source (secondary transfer member cleaning means) 82 is connected to the small-diameter secondary transfer roller 106 that is in contact with the secondary transfer belt 102. The secondary transfer power source 82 can supply the voltage to the small-diameter secondary transfer roller 106, and thus to the secondary transfer belt 102 by changing the polarity of the voltage. Further, the secondary transfer power source 82 also functions as a power source for the secondary transfer. Specifically, the power source generates an electric field between the secondary transfer belt 102 and the back-up roller 71 so that the toner image on the intermediate transfer belt 7 is transferred onto a sheet.

Figure 5:
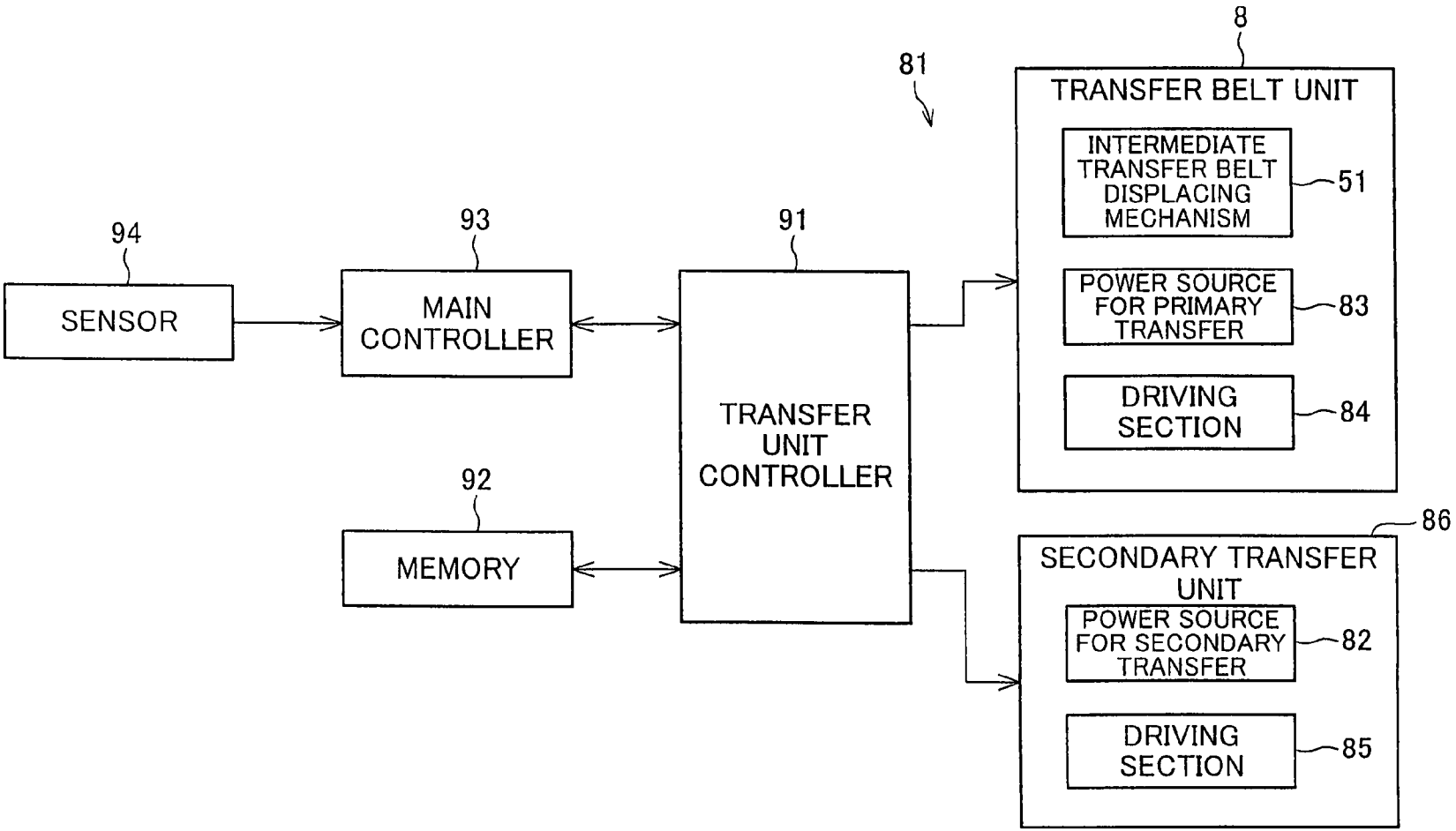
FIG. 5 is a block diagram illustrating a structure of a controlling unit provided in the image forming apparatus shown in FIG. 2.

FIG. 5 is a block diagram schematically illustrating a functional structure of the transfer unit 81 of the image forming apparatus A. The transfer unit 81 is provided with a transfer unit controller (secondary transfer member cleaning means) 91 and a memory 92. The transfer unit controller 91 controls the entire operation of the transfer unit 81, and the memory 92 stores a variety of data. The transfer unit controller 91 controls (i) the intermediate transfer belt unit 8 that is provided with the intermediate transfer belt separating mechanism 51, a primary transfer power-source 83, and a driving section 84 and (ii) the secondary transfer unit 86 that is provided with the secondary transfer power source 82 and a driving section 85. In FIG. 5, the transfer unit controller 91 that controls the transfer unit 81 is provided independently from the main controller 93 that controls the entire operation of the image forming apparatus A. Alternatively, the main controller 93 may also control the transfer unit 81.

The primary transfer power-source 83 of the intermediate transfer belt unit 8 supplies a voltage to the primary transfer roller 6, which voltage is utilized to generate an electric field for transferring the toner image from the photoreceptor drum 3 to the intermediate transfer belt 7. The driving section 84 drives (i) the back-up roller 71 and (ii) the sliding members 53*a* and 53*b* of the intermediate transfer belt separating mechanism 51. The driving section 85 of the secondary transfer unit 86 drives the secondary transfer belt unit 101 and thus drives the supporting roller 103, which functions as the driving roller.

When controlling the operations of the intermediate transfer belt unit 8 and the secondary transfer unit 86, the transfer unit controller 91 (i) communicates with the main controller 93 that controls the entire operation of image forming apparatus A, (ii) obtains necessary information for controlling the image forming apparatus A, and (iii) refers to the data stored in the memory 92. The main controller 93 is connected with various types of sensors (sheet depletion detecting means) 94 for detecting various states of the image forming apparatus A.

On the photoreceptor drum 3, a very little amount of toner-fog (unnecessary toner) is always present. The unnecessary toner adhered to the secondary transfer belt (secondary transfer member) 102 mainly comes from the photoreceptor drum 3 via the intermediate transfer belt 7. Accordingly, in order to block the source of unnecessary toner, it is preferable that the intermediate transfer belt 7 be separated from the photoreceptor drum 3 during the cleaning of the secondary transfer belt 102, which cleaning is performed when no printing operation is conducted by the image forming apparatus A. Further, in order to properly transfer the unnecessary toner from the secondary transfer belt 102 back to the intermediate transfer belt 7 with the applied cleaning electric field and thereby thoroughly clean the secondary transfer belt 102, it is preferable that the intermediate transfer belt 7 be cleaned by using a mechanical method, instead of applying the electric fields.

By (i) separating the intermediate transfer belt 7 from the photoreceptor drum 3 and (ii) cleaning the intermediate transfer belt 7 by the mechanical method as described above, the unnecessary toner can be removed almost completely from the intermediate transfer belt 7, to which the unnecessary toner is to be transferred back from the secondary transfer belt 102. Accordingly, by utilizing the cleaning electric field to clean the secondary transfer belt 102, the unnecessary toner adhered to the secondary transfer belt 102 can be removed desirably.

Therefore, in the transfer unit 81 of the present embodiment, when cleaning of the secondary transfer belt 102 is performed while no printing operation is conducted by the image forming apparatus A, (i) the intermediate transfer belt 7 is separated from the photoreceptor drum 3 by the intermediate transfer belt separating mechanism 51 and (ii) the intermediate transfer belt cleaning unit 9 cleans of the intermediate transfer belt 7 by using the cleaning blade.

Figure 6:
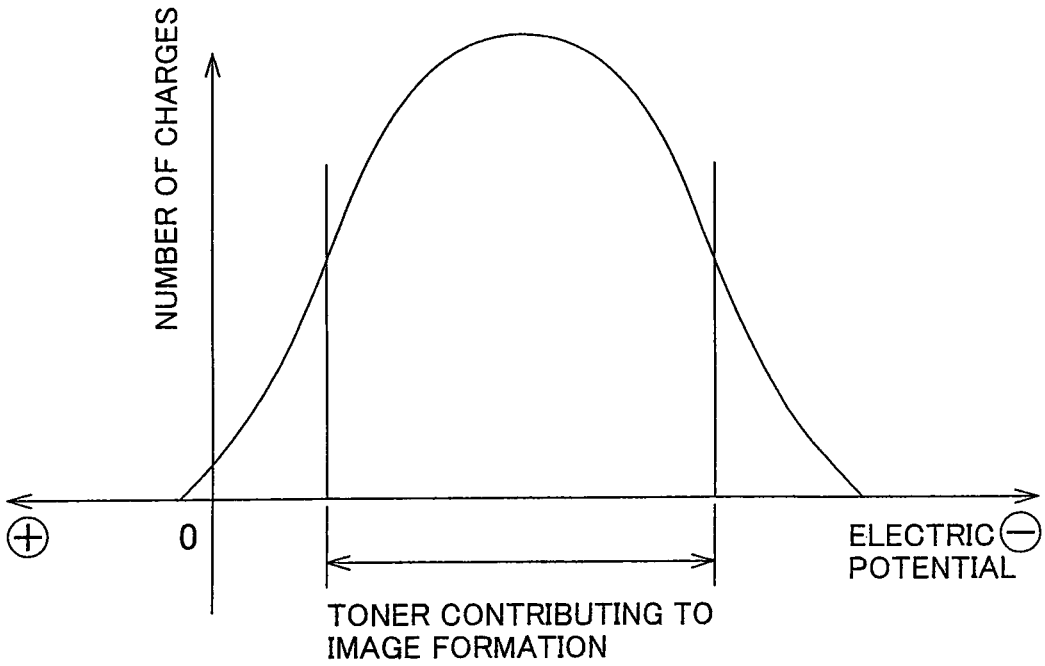
FIG. 6 is a graph showing a common charge distribution of toner.

Further, normally, the amount of charge is not constant between individual toners, and a distribution thereof takes the form as shown in FIG. 6, for example. If the polarity of normally charged toner is negative, then most of the negatively-charged toner contribute to image formation but some of the negatively-charged toner, and the oppositely-charged toner (i.e., positively-charged toner) do not.

If the toner that does not contribute to image formation adheres to the secondary transfer belt 102 by causing toner-fog or air-borne toner, then the toner is transferred from the secondary transfer belt 102 back to the intermediate transfer belt 7 by utilizing the cleaning electric field.

Specifically, a positive voltage and a negative voltage are alternately applied to the secondary transfer belt 102 by the secondary transfer power source 82 so that charges are replenished to (i) normally-charged but weakly-charged toner, and (ii) weakly-charged oppositely-charged toner. This makes it possible to transfer the toner back to the intermediate transfer belt 7 when the secondary transfer belt 102 is applied with a voltage having the same polarity as that of the toner charge. The unnecessary toner transferred back to the intermediate transfer belt 7 is removed and collected from the surface of the intermediate transfer belt 7 by the intermediate transfer belt cleaning unit 9.

The oppositely-charged toner is generated when, for example, the normally-charged toner having been transferred to the intermediate transfer belt 7 is transferred onto a sheet. Specifically, when being transferred onto a sheet at the secondary transfer part, some of the normally-charged toners on the intermediate transfer belt 7 are divided due to friction with the sheet. At this time, some of the divided toners are charged with the opposite polarity, and remains on the intermediate transfer belt 7. This is how the oppositely-charged toner is generated.

Further, as described above, in the image forming apparatus A of the present embodiment, a primary transfer bias is applied to all of the primary transfer rollers 6*a*-6*d* simultaneously, both in forming a monochrome image and in forming a multi-color image, so that the amount of primary transfer bias applied to the intermediate transfer belt 7 is maintained constant. Specifically, if (i) a primary transfer voltage is applied to the primary transfer roller 6*d* at the timing when a yellow toner image is transferred from the photoreceptor drum 3*d* to the intermediate transfer belt 7, (ii) a primary transfer voltage is applied to the primary transfer roller 6*c* at the timing when a magenta toner image is transferred from the photoreceptor drum 3*c* to the intermediate transfer belt 7, and (iii) a primary transfer voltage is sequentially applied to the respective primary transfer rollers 6*b* and 6*a* in the same manner as described above, then the electric potential given in a previous primary transfer would remain on the intermediate transfer belt 7. Therefore, it is necessary in a subsequent primary transfer to appropriately change the voltage applied to the primary transfer roller 6. Such control, however, is extremely complicated. Moreover, if the control is not conducted appropriately, then the transfer bias changes each time the primary transfer is performed at the respective timings. This causes a problem in that the same transfer accuracy cannot be obtained. In order to solve such problems, the above-described method is adopted.

However, if the above method for applying the primary transfer bias is adopted, then the residual toner on the respective photoreceptor drums 3*a*-3*d* would easily be transferred onto the intermediate transfer belt 7. Consequently, unnecessary toner would easily be generated on the secondary transfer belt 102. Therefore, in the image forming apparatus A adopting the method for applying the primary transfer bias, it is highly effective to adopt the method according to the present embodiment so that the unnecessary toner is suitably removed from the secondary transfer belt 102 by using the cleaning electric field.

Figure 7:
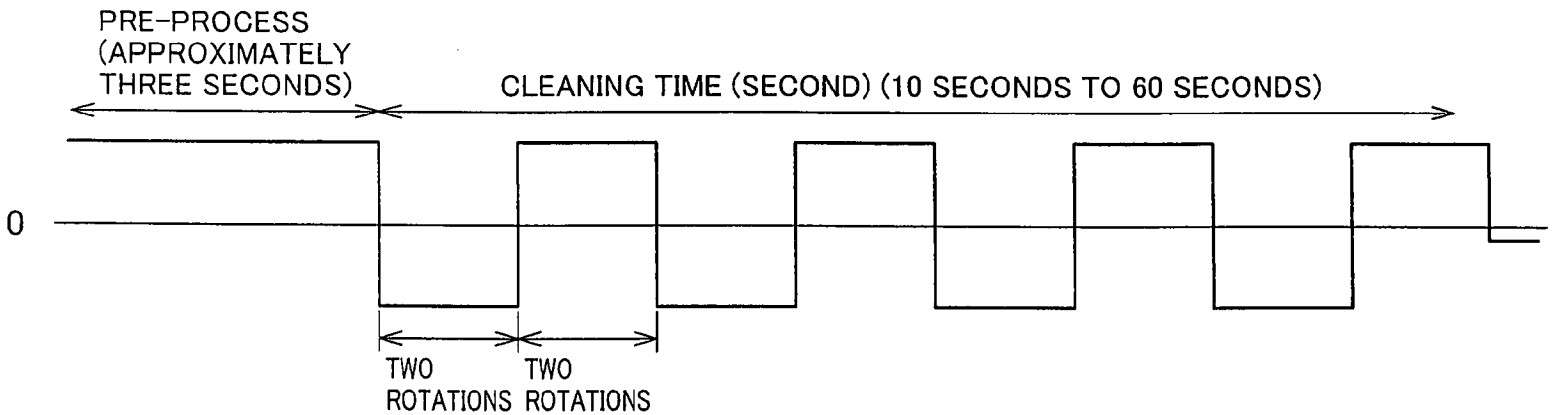
FIG. 7 is a waveform diagram showing how a cleaning electric field is generated in the transfer unit shown in FIG. 1.

As illustrated in FIG. 7, in the image forming apparatus A of the present embodiment, a positive electric field and a negative electric field are alternately applied between the back-up roller 71 and the secondary transfer belt 102 during the cleaning of the secondary transfer belt 102 with the cleaning electric field. In the present embodiment, a constant voltage control to the small-diameter secondary transfer roller 106 is used for generating the negative electric field that transfers the negatively-charged toner (normally-charged toner) from the secondary transfer belt 102 back to the intermediate transfer belt 7. On the other hand, a constant current control to small-diameter secondary transfer roller 106 is used for generating the positive electric field that transfers the positively-charged toner (oppositely-charged toner) from the secondary transfer belt 102 back to the intermediate transfer belt 7. Further, at the beginning of the cleaning, the negative electric field that transfers the negatively-charged toner from the secondary transfer belt 102 back to the intermediate transfer belt 7 is generated first.

In the control operation illustrated in FIG. 7, after a pre-process is performed, the cleaning of the secondary transfer belt 102 is performed by using the cleaning electric field. The period of the pre-process is set to, for example, three seconds. During the pre-process, the intermediate transfer belt 7 is separated from the photoreceptor drums 3*a*-3*d*. Further, during the pre-process, the surface of the intermediate transfer belt 7 with no toner (surface of the intermediate transfer belt 7 which has passed the intermediate transfer belt cleaning unit 9) moves to the nip part of the secondary transfer part. Note that it is preferable that the cleaning of the secondary transfer belt 102 using the cleaning electric field be started after the cleaned surface of the intermediate transfer belt 7 has reached the nip part of the secondary transfer part. The timing to start the cleaning, however, is not limited to the above timing; the cleaning may be started before the cleaned surface reaches the nip part.

In the cleaning of the secondary transfer belt 102, the negative electric field and the positive electric field are switched at every two rotations of the secondary transfer belt 102. The timing of switching the fields, however, is not limited to every two rotations of the secondary transfer belt 102, as long as the fields are switched at least at every rotation. Further, the timing of switching does not need to exactly match the end of the rotation of the secondary transfer belt 102, and the switching may be controlled based on time. For example, switching may be made at an appropriate timing after the completion of at least one rotation. Further, the period of cleaning may be suitably determined in a range of, for example, 10 seconds to 60 seconds, depending upon the state of the apparatus at the time of cleaning.

Note that, the constant current control is employed to generate the positive electric field because the transfer of the toner image from the intermediate transfer belt 7 onto a sheet is performed under the constant current control. This prevents complication in the structure of the high-voltage transformer.

In the image forming apparatus A, the cleaning of the secondary transfer belt 102 is performed at the followings timings: (1) sheet feeding intervals during the printing operation; (2) after a jam recovery process; (3) after the end of a job; (4) after the process control and the automatic registration; (5) during the warm-up operation; and (6) after the detection of sheet depletion in the sheet-feeding cassette. The cleaning of the secondary transfer belt 102 using the cleaning electric field is performed at the timings of (2) to (6) but not in (1). However, generation of unnecessary toner on the secondary transfer belt 102 can be suppressed by performing the cleaning at the timing of (1). The following describes in detail the respective cleaning operations performed at the timings of (1) to (6).

(1) Cleaning in Sheet Feeding Intervals During the Printing Operation

In the case where the printing operation is continuously performed on the sheets and when a sheet exists between the secondary transfer belt 102 and the back-up roller 71, the positive electric field is applied between the secondary transfer belt 102 and the back-up roller 71 so as to transfer the toner images formed on the intermediate transfer belt 7 to the sheet. On the other hand, the negative electric field is applied between the secondary transfer belt 102 and the back-up roller 71 during the sheet feeding interval, which is the time period from the end of the transfer of a toner image onto a current sheet to the arrival of the next sheet between the secondary transfer belt 102 and the back-up roller 71. This prevents toner from adhering to the secondary transfer belt 102 and causing toner-fog thereon during the sheet feeding interval.

(2) Cleaning after Jam Recovery

If paper jam occurs during a continuous printing operation, the toner image, which is supposed to be transferred to a sheet, is transferred to the secondary transfer belt 102. Consequently, numerous unnecessary toners are generated on the secondary transfer belt 102. Therefore, after the paper jam, the secondary transfer belt 102 needs to be cleaned properly so that the back face of the sheet would not be contaminated.

Completion of the jam recovery process is detected by one of the sensors 94 that detects closing of a front cover of the image forming apparatus A. Based upon a detection signal from the sensor 94, the main controller 93 (i) notifies the transfer unit controller 91 of the completion of the jam recovery process and (ii) causes the fixing unit 12 to warm up. When notified of the completion of the jam recovery process, the transfer unit controller 91 causes (i) the intermediate transfer belt separating mechanism 51 to separate the intermediate transfer belt 7 from the photoreceptor drums 3*a*-3*d* and (ii) the driving section 84 to rotate the intermediate transfer belt 7. As a result, the unnecessary toner on the intermediate transfer belt 7 is collected by the intermediate transfer belt cleaning unit 9. Further, the transfer unit controller 91 causes (i) the secondary transfer power source 82 of the secondary transfer unit 86 to generate the cleaning electric field and (ii) the driving section 85 of the secondary transfer unit 86 to rotate the secondary transfer belt 102.

That is, the following processes are performed in cleaning the secondary transfer belt 102 at the respective timings of (2) to (6): separating the intermediate transfer belt 7 from the photoreceptor drums 3*a*-3*d*; cleaning the intermediate transfer belt 7 by using the intermediate transfer belt cleaning unit 9 while the intermediate transfer belt 7 is rotated; and rotating the secondary transfer belt 102. Further, the cleaning performed at the respective timings is always conducted at the processing speed of, for example, a color mode.

Exemplary conditions of the cleaning performed after the jam recovery process are as follows:

Cleaning Period: 30 seconds

Period of Continuous Application of Negative Electric Field: two rotations of the secondary transfer belt Period of Continuous Application of Positive Electric Field: two rotations of the secondary transfer belt.

The positive electric field and the negative electric field are switched at every two rotations of the secondary transfer belt 102. However, the number of rotations is not just limited to two and may be greater than two or may be one.

As described above, in the cleaning of the secondary transfer belt 102, the intermediate transfer belt 7 is separated from the photoreceptor drums 3*a*-3*d* so that no unnecessary toner is additionally transferred from the photoreceptor drums 3*a*-3*d* to the intermediate transfer belt 7. Further, the intermediate transfer belt 7 is cleaned by the intermediate transfer belt cleaning unit 9, so that it is possible to nearly completely eliminate the unnecessary toner from the intermediate transfer belt 7. Moreover, since the unnecessary toner on the secondary transfer belt 102 can be transferred back to the intermediate transfer belt 7 by using the cleaning electric field, the secondary transfer belt 102 can be thoroughly cleaned by the application of the cleaning electric field. The foregoing applies also to the cleaning performed at the timings of (2) to (6).

(3) Cleaning after the End of a Job

When toner images on the intermediate transfer belt 7 are continuously transferred onto the sheets with the secondary transfer belt 102, unnecessary toner keeps accumulating on the secondary transfer belt 102 even in the presence of the negative electric field (opposite bias) applied during the sheet feeding intervals. This is for the following reason. For example, the toner that does not contribute to image formation adheres to regions of the intermediate transfer belt 7 that appear along the sides of the sheet being supplied, although transfer of the unnecessary toner from the intermediate transfer belt 7 to the secondary transfer belt 102 is prevented by the negative electric field during the sheet feeding intervals.

Accordingly, in the present embodiment, the cleaning period of the secondary transfer belt 102 using the cleaning electric field is extended or shortened depending upon the number of sheets printed in one job. Note that, in a case where the image forming apparatus A has accepted a plurality of jobs, the cleaning of the secondary transfer belt 102 is performed each time one job is completed. Further, the number of printed sheets is counted by a counter provided in the image forming apparatus A; this is a conventionally-known structure.

Exemplary conditions of the cleaning performed after the end of a job are as follows:

After a print job of 10 to 99 sheets of A4-size (297 mm×210 mm): 10 seconds;

After a print job of 100 to 499 sheets of A4-size (297 mm×210 mm): 20 seconds; and After a print job of 500 or more sheets of A4-size (297 mm×210 mm): 30 seconds.

Further, the periods of continuous application of the negative electric field and the positive electric field (timing when the positive electric field and the negative electric field are switched) are as follows:

Period of Continuous Application of Negative Electric Field: two rotations of the secondary transfer belt; and Period of Continuous Application of Positive Electric Field: two rotations of the secondary transfer belt.

Note that the switching timing of the positive electric field and the negative electric field is not limited every two rotations of the secondary transfer belt 102, and the number of rotations may be greater than two or may be one.

(4) Cleaning after the Process Control and the Automatic Registration

In the image forming apparatus A, the process control and the automatic registration are performed usually when the power is turned on. Note that the process control is performed to adjust the density of images, whereas the automatic registration is performed for the registration of colors on different images. These adjustments are performed normally when the image forming apparatus A is turned on. In either case, a test toner-patch is formed on the intermediate transfer belt 7. When the toner patch passes an area facing the secondary transfer belt 102, the negative electric field (opposite bias) is applied so as to prevent the toner patch from being transferred onto the secondary transfer belt 102. However, the transfer of the toner patch cannot be prevented perfectly, and some toners are transferred onto the secondary transfer belt 102. Therefore, the secondary transfer belt 102 needs to be cleaned after these adjustments.

Accordingly, after the process control and the automatic registration, the secondary transfer belt 102 is cleaned by the cleaning electric field. For example, the period of cleaning is 10 seconds.

It is not necessarily required that the process control and the automatic registration be always performed at the time when the power is turned ON. For example, the process control and the automatic registration may be omitted in situations where the power is repeatedly turned on and off in a short period of time. Further, the secondary transfer belt 102 may be cleaned either (i) when both of the process control and the automatic registration are finished or (ii) when at least one of the process control and the automatic registration is finished.

(5) Cleaning During the Warm-Up Operation

The warm-up of the fixing unit 12 is conducted at the following timings:

1. when the image forming apparatus A is turned on;
2. when the image forming apparatus A, with the power ON, receives print instructions in a power-saving mode (sleeping mode) that is activated when the image forming apparatus A has not been used for a long period of time; and
3. when the front cover of the image forming apparatus A is closed, for example, to finish the jam recovery process, which had been performed with the front cover of the image forming apparatus A open.

The reason the cleaning of the secondary transfer belt 102 is performed during the warm-up operation after the power has been turned on is that the secondary transfer belt 102 may have been contaminated for some reason before the power is turned on. Further, the cleaning is performed during the warm-up operation after the jam recovery process for the reason explained in Section (2) above.

The cleaning period of the secondary transfer belt 102 with the cleaning electric field is, for example, 10 seconds in the warm-up period.

(6) Cleaning after the Detection of Sheet Depletion in the Sheet-Feeding Cassette When the sheet-feeding cassette is depleted with sheets (no sheet left) during the printing operation, the image forming apparatus A stops operating. At this time, the toner images are on the intermediate transfer belt 7. Even when it is detected that no sheet is left, the toner images are transferred to the intermediate transfer belt 7. This is because, in order to save time, the toner images are transferred onto the photoreceptor drums 3*a*-3*d*, especially on the photoreceptor drum 3*d* locating furthest from the secondary transfer part, before supplying of the sheets from the sheet-feeding cassette is started.

As described above, when the sheets are used up while numerous toners forming the toner images are on the intermediate transfer belt 7, the toners are transferred onto the secondary transfer belt 102. Consequently, unnecessary toner is easily generated on the secondary transfer belt 102. Therefore, when the sensor 94 detects, after the printing operation is started, that the sheet-feeding cassette is out of sheet (no sheet left), the secondary transfer belt 102 needs to be cleaned appropriately.

When depletion of sheets in the sheet-feeding cassette is detected, the cleaning time of the secondary transfer belt 102 by the cleaning electric field is 10 seconds, for example.

Note that, at the timings of (2) to (6), if there is more than one condition for cleaning the secondary transfer belt 102, then the cleaning may be performed based upon one of the conditions. If, however, the periods of cleaning differ among the conditions, then it is preferable that the cleaning be performed based upon a condition that requires the longest period of cleaning.

Tables 1 to 3 show the results of actual cleaning of the secondary transfer belt 102 that was performed under the respective conditions. Note that, in the conventional examples 1 and 2 on Tables 1 and 2, (i) the intermediate transfer belt 7 was not separated from the photoreceptor drums 3*a*-3*d*, and (ii) only the negative electric field (opposite bias) was applied to the secondary transfer part. Further, the item "CONTAMINATION ON THE BACK FACE OF SHEET" indicates whether the back face of sheet has been contaminated after the cleaning.

TABLE 1

(AFTER THE JAM RECOVERY PROCESS IS CONDUCTED: IN THE CASE WHERE A TONER IMAGE IS TRANSFERRED DIRECTLY ONTO THE SECONDARY TRANSFER BELT)

| | | SECOND TRANSFER OPPOSITE BIAS (−) | | SECOND TRANSFER NORMAL BIAS (+) | | DRUM AND INTERMEDIATE TRANSFER BELT SEPARATED | TONER FOG ON PHOTORECEPTOR DRUM | RESIDUAL TONER ON SECONDARY TRANSFER BELT | CONTAMINATION ON THE BACK FACE OF SHEET | DETERMINATION |
|---|---|---|---|---|---|---|---|---|---|---|
| | NO | APPLIED VOLTAGE (V) | APPLICATION TIME (DISTANCE) | APPLIED CURRENT (VOLTAGE) | APPLICATION TIME (DISTANCE) | | | | | |
| CONVENTIONAL EXAMPLE | 1 | −800 | ONE ROTATION OF BELT | NONE | NONE | NO | LITTLE | YES | YES | POOR |
| CONVENTIONAL EXAMPLE | 2 | −800 | FIVE ROTATIONS OF BELT | NONE | NONE | NO | LITTLE | YES | YES | POOR |
| EXAMPLE | 1 | −800 | ONE ROTATION OF BELT | 8 μA (APPROXIMATELY 800 V) | ONE ROTATION OF BELT | NO | LITTLE | LITTLE | LITTLE | AVERAGE |
| EXAMPLE | 2 | −800 | TWO ROTATIONS OF BELT | 8 μA (APPROXIMATELY 800 V) | TWO ROTATIONS OF BELT | NO | LITTLE | VERY LITTLE | NO | GOOD |
| EXAMPLE | 3 | −800 | TWO ROTATIONS OF BELT | 8 μA (APPROXIMATELY 800 V) | TWO ROTATIONS OF BELT | NO | MUCH | LITTLE | LITTLE | AVERAGE |

TABLE 1-continued

| | | (AFTER THE JAM RECOVERY PROCESS IS CONDUCTED: IN THE CASE WHERE A TONER IMAGE IS TRANSFERRED DIRECTLY ONTO THE SECONDARY TRANSFER BELT) | | | | | | | | |
|---|---|---|---|---|---|---|---|---|---|---|
| | | SECOND TRANSFER OPPOSITE BIAS (−) | | SECOND TRANSFER NORMAL BIAS (+) | | DRUM AND INTER-MEDIATE TRANS- | TONER FOG ON | RESID-UAL TONER ON SECOND- | CON-TAMI-NATION ON THE | |
| | NO | APPLIED VOLTAGE (V) | APPLI-CATION TIME (DISTANCE) | APPLIED CURRENT (VOLTAGE) | APPLI-CATION TIME (DISTANCE) | FER BELT SEPA-RATED | PHOTO-RECEP-TOR DRUM | ARY TRANS-FER BELT | BACK FACE OF SHEET | DE-TERMI-NA-TION |
| EXAMPLE | 4 | −800 | TWO ROTATIONS OF BELT | 8 μA (APPROXI-MATELY 800 V) | TWO ROTATIONS OF BELT | YES | MUCH | NO | NO | VERY GOOD |

TABLE 2

| | | (AFTER THE PROCESS CONTROL AND THE AUTOMATIC REGISTRATION ARE FINISHED/AFTER OUT-OF-PAPER STATE OF PAPER FEEDING CASSETTE IS DETECTED) | | | | | | | | |
|---|---|---|---|---|---|---|---|---|---|---|
| | | SECOND TRANSFER OPPOSITE BIAS (−) | | SECOND TRANSFER NORMAL BIAS (+) | | DRUM AND INTER-MEDIATE TRANS- | TONER FOG ON | RESID-UAL TONER ON SECOND- | CON-TAMI-NATION ON THE | |
| | NO | APPLIED VOLTAGE (V) | APPLI-CATION TIME (DISTANCE) | APPLIED CURRENT (VOLTAGE) | APPLI-CATION TIME (DISTANCE) | FER BELT SEPA-RATED | PHOTO-RECEP-TOR DRUM | ARY TRANS-FER BELT | BACK FACE OF SHEET | DE-TERMI-NA-TION |
| CONVEN-TIONAL EXAMPLE | 1 | −800 | ONE ROTATION OF BELT | NONE | NONE | NO | LITTLE | YES | YES | POOR |
| CONVEN-TIONAL EXAMPLE | 2 | −800 | FIVE ROTATIONS OF BELT | NONE | NONE | NO | LITTLE | YES | YES | POOR |
| EXAMPLE | 1 | −800 | ONE ROTATION OF BELT | 8 μA (APPROXI-MATELY 800 V) | ONE ROTATION OF BELT | NO | LITTLE | LITTLE | LITTLE | AVERAGE |
| EXAMPLE | 2 | −800 | TWO ROTATIONS OF BELT | 8 μA (APPROXI-MATELY 800 V) | TWO ROTATIONS OF BELT | NO | LITTLE | VERY LITTLE | NO | GOOD |
| EXAMPLE | 3 | −800 | TWO ROTATIONS OF BELT | 8 μA (APPROXI-MATELY 800 V) | TWO ROTATIONS OF BELT | NO | MUCH | LITTLE | LITTLE | AVERAGE |
| EXAMPLE | 4 | −800 | TWO ROTATIONS OF BELT | 8 μA (APPROXI-MATELY 800 V) | TWO ROTATIONS OF BELT | YES | MUCH | NO | NO | VERY GOOD |

TABLE 3

| | | | | (AFTER ONE JOB IS COMPLETED) | | | | | | |
|---|---|---|---|---|---|---|---|---|---|---|
| | | SECOND TRANSFER OPPOSITE BIAS (−) | | SECOND TRANSFER NORMAL BIAS (+) | | DRUM AND INTER-MEDIATE TRANS- | TONER FOG ON | RESID-UAL TONER ON SECOND- | CON-TAMI-NATION ON THE | |
| NO | NUMBER OF PRINTED SHEETS | APPLIED VOLTAGE (V) | APPLI-CATION TIME (DISTANCE) | APPLIED CURRENT (VOLTAGE) | APPLI-CATION TIME (DISTANCE) | FER BELT SEPA-RATED | PHOTO-RECEP-TOR DRUM | ARY TRANS-FER BELT | BACK FACE OF SHEET | DE-TERMI-NA-TION |
| 1 | 10 | −800 | ONE ROTATION OF BELT | NONE | ONE ROTATION OF BELT | YES | MUCH | NO | NO | VERY GOOD |

TABLE 3-continued

| | | | | | | (AFTER ONE JOB IS COMPLETED) | | | | |
|---|---|---|---|---|---|---|---|---|---|---|
| | | SECOND TRANSFER OPPOSITE BIAS (−) | | SECOND TRANSFER NORMAL BIAS (+) | | DRUM AND INTER-MEDIATE TRANS- | TONER FOG ON | RESID-UAL TONER ON SECOND- | CON-TAMI-NATION ON THE | |
| NO | NUMBER OF PRINTED SHEETS | APPLIED VOLTAGE (V) | APPLI-CATION TIME (DISTANCE) | APPLIED CURRENT (VOLTAGE) | APPLI-CATION TIME (DISTANCE) | FER BELT SEPA-RATED | PHOTO-RECEP-TOR DRUM | ARY TRANS-FER BELT | BACK FACE OF SHEET | DE-TERMI-NA-TION |
| 2 | 100 | −800 | ONE ROTATION OF BELT | NONE | ONE ROTATION OF BELT | YES | MUCH | LITTLE | LITTLE | AVERAGE |
| 3 | 100 | −800 | TWO ROTATIONS OF BELT | 8 μA (APPROXI-MATELY 800 V) | TWO ROTATIONS OF BELT | YES | MUCH | NO | NO | VERY GOOD |
| 4 | 500 | −800 | TWO ROTATIONS OF BELT | 8 μA (APPROXI-MATELY 800 V) | TWO ROTATIONS OF BELT | YES | MUCH | LITTLE | LITTLE | AVERAGE |
| 5 | 500 | −800 | FOUR ROTATIONS OF BELT | 8 μA (APPROXI-MATELY 800 V) | FOUR ROTATIONS OF BELT | YES | MUCH | VERY LITTLE | VERY LITTLE | GOOD |
| 6 | 500 | −800 | (TWO ROTATIONS) ×2 OF BELT | 8 μA (APPROXI-MATELY 800 V) | (TWO ROTATIONS) ×2 OF BELT | YES | MUCH | NO | NO | VERY GOOD |

Table 1 shows the results of cleaning the secondary transfer belt 102 that was performed after the jam recovery process was finished. Table 1 compares the effects of cleaning in the case where the toner images having been transferred onto the intermediate transfer belt 7 are transferred onto the secondary transfer belt 102.

As Table 1 shows, in conventional examples 1 and 2, residual toner was generated on the secondary transfer belt 102, and the back face of sheet was contaminated (Determination: Poor). On the contrary, in the case where (i) the intermediate transfer belt 7 was separated from the photoreceptor drums 3*a*-3*d*, (ii) the negative electric field was applied and the secondary transfer belt 102 was rotated for two rotations, and subsequently (iii) the positive electric field was applied and the secondary transfer belt 102 was rotated for two rotations (Example 4), no residual toner was generated on the secondary transfer belt 102, and the back faces of the sheets were not contaminated, even when a large amount of toner-fog was generated on the photoreceptor drums 3*a*-3*d*. In this case, the most desirable result (Determination: Very Good) was obtained.

Further, in Examples 2 and 3, (i) the intermediate transfer belt 7 was not separated from the photoreceptor drums 3*a*-3*d*, (ii) the negative electric field was applied and the secondary transfer belt 102 was rotated for two rotations, and subsequently (iii) the positive electric field was applied and the secondary transfer belt 102 was rotated for two rotations. In this case, if only a little amount of toner-fog existed on the photoreceptor drums 3*a*-3*d* (Example 2), then very little amount of residual toner existed on the secondary transfer belt 102, and the back face of the sheet was not contaminated. As a result, a desirable result (Determination: Good) was obtained. On the other hand, in the case where a large amount of toner-fog existed on the photoreceptor drums 3*a*-3*d* (Example 3), improvements were made over the conventional examples 1 and 2 with regard to the residual toner and the contamination on the back face of sheet, although a little amount of residual toner existed on the secondary transfer belt 102, and the back face of the sheet was slightly contaminated.

Further, in the case where (i) the intermediate transfer belt 7 was not separated from the photoreceptor drums 3*a*-3*d* and (ii) each of the negative electric field and the positive electric field was applied for the period equal to one rotation of the secondary transfer belt 102 (Example 1), improvements were made over the conventional examples 1 and 2 with regard to the residual toner and the contamination on the back face of sheet, although a little amount of residual toner existed on the secondary transfer belt 102, and the back face of the sheet was slightly contaminated.

Table 2 shows (i) the results of cleaning the secondary transfer belt 102 that was performed after the process control and the automatic registration and (ii) the results of cleaning the secondary transfer belt 102 that was performed after depletion of sheets in the sheet-feeding cassette was detected. The same results were obtained in both cases.

As Table 2 shows, in the conventional examples 1 and 2, the residual toner was generated on the secondary transfer belt 102, and the back face of the sheet was contaminated after the cleaning had been performed. On the contrary, in the case where (i) the intermediate transfer belt 7 was separated from the photoreceptor drums 3*a*-3*d*, (ii) the negative electric field was applied and the secondary transfer belt 102 was rotated for two rotations, and subsequently (iii) the positive electric field was applied and the secondary transfer belt 102 was rotated for two rotations (Example 4), no residual toner existed on the secondary transfer belt 102, and the back face of the sheet was not contaminated, even when a large amount of toner-fog existed on the photoreceptor drums 3*a*-3*d*. In this case, the most desirable result (Determination: Very Good) was obtained.

Further, in Examples 2 and 3, (i) the intermediate transfer belt 7 was not separated from the photoreceptor drums 3*a*-3*d*, (ii) the negative electric field was applied and the secondary transfer belt 102 was rotated for two rotations, and subsequently (iii) the positive electric field was applied and the secondary transfer belt 102 was rotated for two rotations (Examples 2 and 3). In this case, if only a little amount of toner-fog existed on the photoreceptor drums 3*a*-3*d* (Example 2), then very little amount of residual toner existed on the secondary transfer belt 102, and the back face of the sheet was not contaminated. As a result, a desirable result (Determination: Good) was obtained. On the other hand, in the case where a large amount of toner-fog existed on the photoreceptor drums 3*a*-3*d* (Example 3), improvements were made over the conventional examples 1 and 2 with regard to the residual toner and the contamination on the back face of sheet, although a little amount of residual toner existed on the secondary transfer belt 102, and the back face of the sheet was slightly contaminated.

Further, in the case where (i) the intermediate transfer belt 7 was not separated from the photoreceptor drums 3*a*-3*d* and (ii) each of the negative electric field and the positive electric field was applied for the period equal to one rotation of the secondary transfer belt 102 (Example 1), improvements were made over the conventional examples 1 and 2 with regard to the residual toner and the contamination on the back face of sheet, although a little amount of residual toner existed on the secondary transfer belt 102, and the back face of the sheet was slightly contaminated.

Table 3 shows the results of cleaning the secondary transfer belt 102 that was performed after the end of a job. In examples No. 1 to No. 6, the intermediate transfer belt 7 was separated from the photoreceptor drums 3*a*-3*d*, and the cleaning electric field constituted of the positive electric field and the negative electric field were applied to the secondary transfer part. However, the respective electric fields were applied for different lengths of time (numbers of rotations of the secondary transfer belt 102).

As Table 3 shows, in the case where the number of printed sheets was 10 (No. 1), the respective negative electric field and positive electric field were applied for a period equal to one rotation of the secondary transfer belt 102. As a result, no residual toner existed on the secondary transfer belt 102, and the back face of the sheet was not contaminated. In this case, the most desirable result (Determination: Very Good) was obtained.

In the case where the number of printed sheets was 100 (No. 2 and No. 3), (i) the negative electric field was applied and the secondary transfer belt 102 was rotated for two rotations, and subsequently (ii) the positive electric field was applied and the secondary transfer belt 102 was rotated for two rotations (No. 3). As a result, no residual toner existed on the secondary transfer belt 102, and the back face of the sheet was not contaminated. In this case, the most desirable result (Determination: Very Good) was obtained. Further, in the case where the respective negative electric field and positive electric field were applied for a period equal to one rotation of the secondary transfer belt 102 (No. 2), improvements were made over the conventional examples 1 and 2 with regard to the residual toner and the contamination on the back face of the sheet, although a little amount of residual toner existed on the secondary transfer belt 102, and the back face of the sheet was slightly contaminated.

In the case where the number of printed sheets was 500 (No. 4 to No. 6), (i) the negative electric field was applied and the secondary transfer belt 102 was rotated for two rotations, and subsequently (ii) the positive electric field was applied and the secondary transfer belt 102 was rotated for two rotations, and (iii) the processes of (i) and (ii) were repeated twice (No. 6). As a result, no residual toner existed on the secondary transfer belt 102, and the back face of the sheet was not contaminated. In this case, the most desirable result (Determination: Very Good) was obtained. Further, in the case where (i) the negative electric field was applied and the secondary transfer belt 102 was rotated for four rotations, and subsequently (ii) the positive electric field was applied and the secondary transfer belt 102 was rotated for four rotations (No. 5), only a little amount of residual toner existed on the secondary transfer belt 102, and the back face of the sheet was contaminated only slightly. In this case, a desirable result (Determination: Good) was obtained. Further, in the case where (i) the negative electric field was applied and the secondary transfer belt 102 was rotated for two rotations, and subsequently (ii) the positive electric field was applied and the secondary transfer belt 102 was rotated for two rotations (No. 4), improvements were made over the conventional examples 1 and 2 with regard to the residual toner and the contamination on the back face of the sheet, although a little amount of residual toner existed on the secondary transfer belt 102, and the back face of the sheet was slightly contaminated.

The above results show that (i) the unnecessary toner on the secondary transfer belt 102 can be removed, and (ii) contamination of the back face of the sheet can be prevented, both in a reliable manner, by (a) separating the intermediate transfer belt 7 from the photoreceptor drums 3*a*-3*d* during the cleaning of the secondary transfer belt 102, and (b) sequentially applying the negative electric field and the positive electric field to the secondary transfer part during the cleaning of the secondary transfer belt 102. Further, even in the case where the intermediate transfer belt 7 is not separated from the photoreceptor drums 3*a*-3*d*, by sequentially applying the negative electric field and the positive electric field to the secondary transfer part, it was found that both (i) the unnecessary toner on the secondary transfer belt 102 and (ii) the contamination on the back face of the sheet can be reduced, compared with the conventional art.

Figure 8:
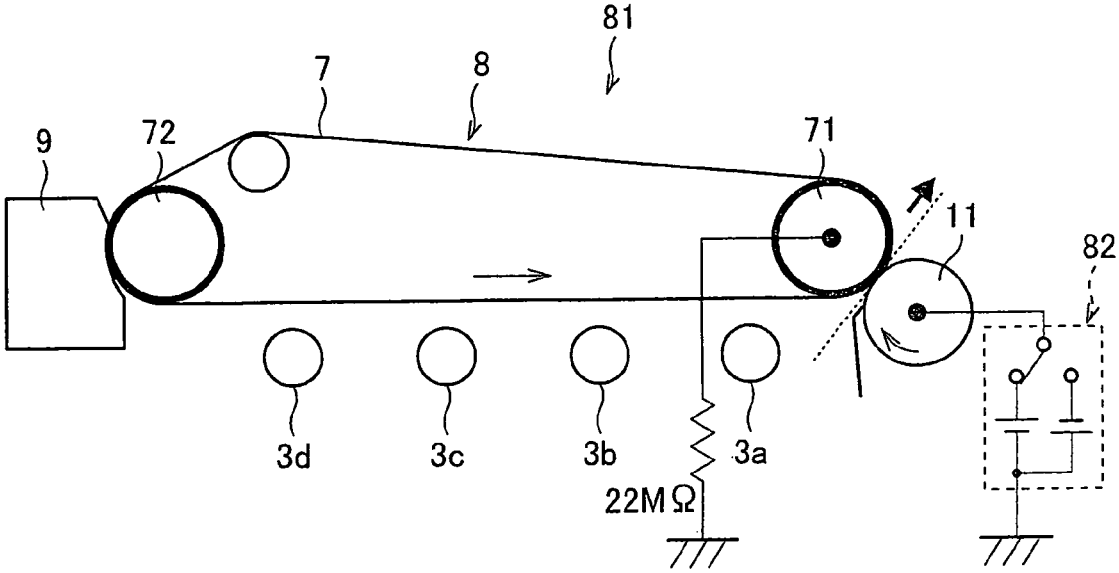
FIG. 8 is a schematic diagram illustrating a structure in which the secondary transfer belt of the transfer unit shown in FIG. 1 is replaced by a secondary transfer roller.

FIG. 8 illustrates a structure in which the secondary transfer belt unit 101 shown in FIG. 1 is replaced by a transfer roller. The secondary transfer roller 11 in FIG. 8 has a known structure in which the outer surface of a flexible foam rubber roller is covered by a tube made of resin. At the secondary transfer part where the back-up roller 71 comes into contact with the secondary transfer roller 11, the back-up roller 71 is pressed against the secondary transfer roller 11 so that the back-up roller 71 bites the secondary transfer roller 11. This ensures a sufficient nip width for the secondary transfer.

Providing a mechanical cleaning mechanism for the secondary transfer roller 11 of the flexible material as above is not desirable because it is detrimental to the durability of the secondary transfer roller 11 and may damage the secondary transfer roller 11. Accordingly, in the same manner as in FIG. 1, the secondary transfer roller 11 is provided with a cleaning mechanism in which the negative electric field and the positive electric field are alternately applied between the secondary transfer roller 11 and the back-up roller 71.

The present invention is applicable to image forming apparatuses, such as a copying machine and a printer, in which toner is used.

As described above, the transfer unit may further include intermediate transfer member displacing mechanism for bringing the intermediate transfer member into contact with the toner image holding member or separating the intermediate transfer member from the toner image holding member, and the intermediate transfer member displacing mechanism may separate the intermediate transfer member from the toner image holding member while the secondary transfer member cleaning unit is applying one of the first voltage and the second voltage to the secondary transfer member.

In the above structure, the intermediate transfer member is separated from the toner image holding member while the secondary transfer member cleaning unit is applying the first voltage and the second voltage to the secondary transfer member. This blocks the toner image holding member, which may generate unnecessary toner, from the intermediate transfer member. Therefore, unnecessary toner would not be additionally transferred to the secondary transfer member through the toner image holding member and then through the intermediate transfer member, during the cleaning of the secondary transfer member. This improves reliability of the cleaning of the secondary transfer member.

In the transfer unit, the intermediate transfer member cleaning unit may (i) come into contact with the toner image holding surface of the intermediate transfer member and (ii) scratch off and the toner therefrom to collect the toner.

In the above structure, the intermediate transfer member cleaning unit is brought into contact with the toner image holding surface of the intermediate transfer member, so as to scratch off the toner therefrom. As a result, the intermediate transfer member is cleaned without affecting the electric field that is applied to clean the secondary transfer member.

In the transfer unit, the secondary transfer member cleaning unit may apply the first voltage and the second voltage to the secondary transfer member after the surface of the intermediate transfer member having been cleaned by the intermediate transfer member cleaning unit gets to a contact location, at the secondary transfer part, with the secondary transfer member.

In the above structure, a surface having been cleaned comes to the opposite position to the secondary transfer member at the time when the secondary transfer member cleaning unit cleans the secondary transfer member. This prevents transferring of unnecessary toner from the intermediate transfer member to the secondary transfer member, which transferring may be caused by the cleaning electric field. Therefore, reliability of the cleaning of the secondary transfer member is improved.

In the transfer unit, a surface of the secondary transfer member may rotate to move, and the secondary transfer member cleaning unit, when switching the first voltage and the second voltage, may (i) apply the first voltage and the second voltage each for a time period of at least one rotation of the surface of the secondary transfer member, and (ii) apply the first voltage and the second voltage in at least one cycle.

The above structure ensures the entire surface of the secondary transfer member is cleaned. Therefore, reliability of the cleaning of the secondary transfer member is improved.

In the transfer unit, the secondary transfer member cleaning unit, when switching the first voltage and the second voltage, may (i) apply the first voltage and the second voltage each for a time period of at least plural rotations of the surface of the secondary transfer member, and (ii) apply the cycle of the first voltage and the second voltage for plural times.

In the above structure, the entire surface of the secondary transfer member is repeatedly cleaned. Therefore, reliability of the cleaning of the secondary transfer member is improved.

In the transfer unit, the secondary transfer member cleaning unit may finish applying the first voltage and the second voltage to the secondary transfer member within one rotation of the intermediate transfer member being cleaned by the intermediate transfer member cleaning unit.

In the above structure, the cleaning of the secondary transfer member is completed within one rotation of the intermediate transfer member being cleaned. Therefore, providing an additional period for cleaning the secondary transfer member is not necessary. This prevents deceleration in the processing speed of the apparatus, which deceleration may be caused by the cleaning of the secondary transfer member.

In the transfer unit, the secondary transfer member cleaning unit may changes a voltage-applied cleaning time of the secondary transfer member according to a state of the transfer unit to be cleaned.

In the above structure, the cleaning time of the secondary transfer member is changed according to a state of the transfer unit to be cleaned. Therefore, the cleaning of the secondary transfer member is suitably performed based upon the state of the transfer unit (for example, based upon the number of sheets onto which toner images have been transferred in continuous processing).

In the transfer unit, the toner image may be transferred, at the secondary transfer part, from the intermediate transfer member to the sheet by an electric field that is generated by a voltage applied to the secondary transfer member, and when the voltage applied to the secondary transfer member is V3, the first voltage is V1, and the second voltage is V2, then the voltages V1 to V3 may be related to each other as below:

$$|V3| \geqq |V1|,\ |V3| \geqq |V2|.$$

In the above structure, the number of charges of unnecessary toner remained on the secondary transfer member is fewer than that of the normally-charged toner to be transferred onto a sheet at the secondary transfer. Therefore, it is possible to set an optimum voltage for cleaning lower than the transfer voltage for transferring of the toner to the sheet.

In the transfer unit, an absolute value of the voltage V1 and an absolute value of the voltage V2 may be equal to each other. This facilitates the voltage control in cleaning the secondary transfer member.

The image forming apparatus of the present invention is adapted so as to include one of the above transfer units. With this structure, the cleaning of the secondary transfer member is suitably performed in the image forming apparatus.

In the image forming apparatus, the secondary transfer member cleaning unit may apply the first voltage and the second voltage to the secondary transfer member each time a job including a printing operation is finished in the image forming apparatus.

In the above structure, the unnecessary toner on the secondary transfer member, which unnecessary toner was generated when a job was performed by the image forming apparatus, can be removed. This prevents the toner from contaminating the back face of the sheet in the subsequent jobs.

In the image forming apparatus, the secondary transfer member cleaning unit may apply the first voltage and the second voltage to the secondary transfer member after at least one of a process control operation and an automatic registration operation.

In the above structure, although the unnecessary toner is easily generated on the secondary transfer member by one or both of the process control and the automatic registration, the unnecessary toner can be removed from the secondary transfer member.

The image forming apparatus may include a fixing unit that heats the transferred toner image on a sheet so as to fuse the toner image with the sheet, and the secondary transfer member cleaning unit may apply the first voltage and the second voltage to the secondary transfer member while the fixing unit is in a warm-up operation.

In the above structure, the unnecessary toner generated on the secondary transfer member before the warm-up operation is performed can be removed. Therefore, it is not necessary to provide an additional period of cleaning the secondary transfer member.

The image forming apparatus may include detecting means for detecting depletion of sheets in a sheet-feeding cassette, and the secondary transfer member cleaning unit may apply the first voltage and the second voltage to the secondary transfer member when depletion of sheets in the sheet-feeding cassette is detected by the detecting means.

When no sheet is supplied, the toner image transferred onto the intermediate transfer member is transferred directly onto the secondary transfer member. Consequently, a large amount of unnecessary toner is generated on the secondary transfer member. With the above structure, the unnecessary toner can be removed.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A transfer unit, comprising:

an intermediate transfer member that (i) holds a toner image that has been transferred, at a primary transfer part, from a toner image holding member and (ii) rotates to move a toner image holding surface holding the toner image;

a secondary transfer member that comes into contact, at a secondary transfer part, with the intermediate transfer member; and intermediate transfer member cleaning means for removing and collecting toner from the toner image holding surface of the intermediate transfer member, the transfer unit transferring the toner image from the intermediate transfer member to a sheet conveyed to the secondary transfer part formed between the intermediate transfer member and the secondary transfer member, wherein the transfer unit further comprises, secondary transfer member cleaning means for sequentially applying, to the secondary transfer member, (i) a first voltage for generating an electric field that transfers normally-charged toner from the secondary transfer member to the intermediate transfer member and (ii) a second voltage for generating an electric field that transfers oppositely-charged toner from the secondary transfer member to the intermediate transfer member, and intermediate transfer member displacing means for bringing the intermediate transfer member into contact with the toner image holding member or separating the intermediate transfer member from the toner image holding member, wherein the intermediate transfer member displacing means separates the intermediate transfer member from the toner image holding member while the secondary transfer member cleaning means is applying one of the first voltage and the second voltage to the secondary transfer member.

2. A transfer unit as set forth in claim 1, wherein the intermediate transfer member cleaning means (i) comes into contact with the toner image holding surface of the intermediate transfer member and (ii) scratches off the toner therefrom to collect the toner.

3. A transfer unit as set forth in claim 1, wherein the secondary transfer member cleaning means applies the first voltage and the second voltage to the secondary transfer member after the surface of the intermediate transfer member having been cleaned by the intermediate transfer member cleaning means gets to a contact location, at the secondary transfer part, with the secondary transfer member.

4. A transfer unit as set forth in claim 1, wherein a surface of the secondary transfer member rotates to move, and the secondary transfer member cleaning means, when switching the first voltage and the second voltage, (i) applies the first voltage and the second voltage each for a time period of at least one rotation of the surface of the secondary transfer member, and (ii) applies the first voltage and the second voltage in at least one cycle.

5. A transfer unit as set forth in claim 4, wherein the secondary transfer member cleaning means, when switching the first voltage and the second voltage, (i) applies the first voltage and the second voltage each for a time period of at least plural rotations of the surface of the secondary transfer member, and (ii) applies the cycle of the first voltage and the second voltage for plural times.

6. A transfer unit as set forth in claim 1, wherein the secondary transfer member cleaning means finishes applying the first voltage and the second voltage to the secondary transfer member within one rotation of the intermediate transfer member being cleaned by the intermediate transfer member cleaning means.

7. A transfer unit as set forth in claim 1, wherein the secondary transfer member cleaning means changes a voltage-applied cleaning time of the secondary transfer member according to a state of the transfer unit to be cleaned.

8. A transfer unit as set forth in claim 1, wherein the toner image is transferred, at the secondary transfer part, from the intermediate transfer member to the sheet by an electric field that is generated by a voltage applied to the secondary transfer member, and wherein when a voltage applied to the secondary transfer member is V3, the first voltage is indicated as V1, and the second voltage is indicated as V2, the voltages V1 to V3 have the following relationship:

$$|V3| \geqq |V1|, |V3| \geqq |V2|.$$

9. A transfer unit as set forth in claim 8, wherein an absolute value of the voltage V1 and an absolute value of the voltage V2 are equal to each other.

10. A transfer unit, comprising:

an intermediate transfer member that (i) holds a toner image that has been transferred, at a primary transfer part, from a toner image holding member and (ii) rotates to move a toner image holding surface holding the toner image;

a secondary transfer member that comes into contact, at a secondary transfer part, with the intermediate transfer member; and an intermediate transfer member cleaning unit that mechanically removes and collects toner by using a cleaning member coming into contact with the toner image holding surface of the intermediate transfer member, the transfer unit transferring the toner image from the intermediate transfer member to a sheet conveyed to the secondary transfer part formed between the intermediate transfer member and the secondary transfer member, wherein the transfer unit further comprises, a secondary transfer member cleaning unit (i) having a power source for generating (a) a first voltage for generating an electric field that transfers normally-charged toner from the secondary transfer member to the intermediate transfer member and (b) a second voltage for generating an electric field that transfers oppositely-charged toner from the secondary transfer member to the intermediate transfer member, and (ii) sequentially applying the first voltage and the second voltage to the secondary transfer member by using the power source, and an intermediate transfer member displacing unit for bringing the intermediate transfer member into contact with the toner image holding member or separating the intermediate transfer member from the toner image holding member, wherein the intermediate transfer member displacing unit separates the intermediate transfer member from the toner image holding member while the secondary transfer member cleaning unit is applying one of the first voltage and the second voltage to the secondary transfer member.

11. A transfer method, comprising:

transferring a toner image from an intermediate transfer member to a sheet conveyed to the secondary transfer part formed between the intermediate transfer member and the secondary transfer member, the intermediate transfer member being provided to (a) hold a toner image that has been transferred, at a primary transfer part, from a toner image holding member and (b) rotate to move the surface holding the toner image, and the secondary transfer member being provided to comes into contact, at a secondary transfer part, with the intermediate transfer member;

removing and collecting the toner from the toner holding surface of the intermediate transfer member; and sequentially applying (i) a first electric field for transferring normally-charged toner from the secondary transfer member to the intermediate transfer member and (ii) a second electric field for transferring oppositely-charged toner from the secondary transfer member to the intermediate transfer member; and separating the intermediate transfer member from the toner image holding member during the sequentially applying step, the separating step separating the intermediate transfer member from the toner image holding member while applying one of the first electric field and the second electric field to the intermediate transfer member.

12. An image forming apparatus, comprising:

a transfer unit (i) including, an intermediate transfer member that (a) holds a toner image that has been transferred, at a primary transfer part, from a toner image holding member and (b) rotates to move a toner image holding surface holding the toner image, a secondary transfer member that comes into contact, at a secondary transfer part, with the intermediate transfer member, and intermediate transfer member cleaning means for removing and collecting toner from the toner image holding surface of the intermediate transfer member, and (ii) transferring the toner image from the intermediate transfer member to a sheet conveyed to the secondary transfer part formed between the intermediate transfer member and the secondary transfer memberl and, secondary transfer member cleaning means for sequentially applying, to the secondary transfer member, (i) a first voltage for generating an electric field that transfers normally-charged toner from the secondary transfer member to the intermediate transfer member and (ii) a second voltage for generating an electric field that transfers oppositely-charged toner from the secondary transfer member to the intermediate transfer member; and an intermediate transfer member displacing unit for bringing the intermediate transfer member into contact with the toner image holding member or separating the intermediate transfer member from the toner image holding member, wherein the intermediate transfer member displacing means separates the intermediate transfer member from the toner image holding member while the secondary transfer member cleaning means is applying one of the first voltage and the second voltage to the secondary transfer member.

13. An image forming apparatus as set forth in claim 12, wherein the secondary transfer member cleaning means applies the first voltage and the second voltage to the secondary transfer member each time a job including a printing operation is finished in the image forming apparatus.

14. An image forming apparatus as set forth in claim 12, wherein the secondary transfer member cleaning means applies the first voltage and the second voltage to the secondary transfer member after at least one of a process control operation and an automatic registration operation.

15. An image forming apparatus as set forth in claim 12, further comprising:

a fixing unit that heats the transferred toner image on a sheet so as to fuse the toner image with the sheet, wherein the secondary transfer member cleaning means applies the first voltage and the second voltage to the secondary transfer member while the fixing unit is in a warm-up operation.

16. An image forming apparatus as set forth in claim 12, further comprising:

detecting means for detecting depletion of sheets in a sheet-feeding cassette, wherein the secondary transfer member cleaning means applies the first voltage and the second voltage to the secondary transfer member when depletion of sheets in the sheet-feeding cassette is detected by the detecting means.

* * * * *